US005399466A

United States Patent [19]

Hamer

[11] Patent Number: 5,399,466

[45] Date of Patent: Mar. 21, 1995

[54] [METHOD OF PROCESSING] PHOTOGRAPHIC ELEMENTS HAVING FOGGED GRAINS AND DEVELOPMENT INHIBITORS FOR INTERIMAGE

[75] Inventor: John W. Hamer, Rochester, N.Y.

[73] Assignee: Eastman Kodak Company, Rochester, N.Y.

[21] Appl. No.: 5,472

[22] Filed: Jan. 15, 1993

[51] Int. Cl.[6] ..... G03C 7/46

[52] U.S. Cl. ..... 430/379; 430/407; 430/359; 430/505; 430/544; 430/957; 430/567

[58] Field of Search ..... 430/957, 505, 544, 567, 430/407, 359, 379

[56] References Cited

U.S. PATENT DOCUMENTS

| | | | |
|---|---|---|---|
| 3,536,487 | 10/1970 | Graham | 430/957 |
| 4,036,646 | 7/1977 | Hellmig et al. | 430/504 |
| 4,082,553 | 4/1978 | Groet | 430/504 |
| 4,258,127 | 3/1981 | Ishibashi et al. | 430/379 |
| 4,310,617 | 1/1982 | Mollet et al. | 430/359 |
| 4,368,256 | 1/1983 | Mollet et al. | 430/359 |
| 4,431,728 | 2/1984 | Abe et al. | 430/544 |
| 4,461,826 | 7/1984 | Yamashita et al. | 430/505 |
| 4,480,028 | 10/1984 | Kato et al. | 430/544 |
| 4,482,629 | 11/1984 | Nakagawa et al. | 430/542 |
| 4,618,571 | 10/1986 | Ichijima et al. | 430/505 |
| 4,626,498 | 12/1986 | Shuto et al. | 430/379 |
| 4,663,271 | 5/1987 | Nozawa et al. | 430/503 |
| 4,720,451 | 1/1988 | Shuto et al. | 430/379 |
| 4,729,943 | 3/1988 | Pfaff et al. | 430/362 |
| 4,772,546 | 9/1988 | Deguchi et al. | 430/603 |
| 4,788,132 | 11/1988 | Deguchi et al. | 430/505 |
| 4,818,670 | 4/1989 | Yagi et al. | 430/544 |
| 4,962,018 | 10/1990 | Szajewski et al. | 430/544 |
| 5,006,448 | 4/1991 | Szajewski et al. | 430/505 |
| 5,021,555 | 6/1991 | Szajewski et al. | 430/957 |
| 5,024,925 | 6/1991 | Deguchi | 430/379 |
| 5,032,496 | 7/1991 | Hattori et al. | 430/504 |

FOREIGN PATENT DOCUMENTS

| | | |
|---|---|---|
| 0296784 | 12/1988 | European Pat. Off. . |
| 0296785 | 12/1988 | European Pat. Off. . |
| 0349331 | 6/1989 | European Pat. Off. . |
| 442323 | 8/1991 | European Pat. Off. . |
| 0481427 | 4/1992 | European Pat. Off. . |
| 4135312 | 4/1992 | Germany . |

(List continued on next page.)

OTHER PUBLICATIONS

Interlayer Enhancement of Interimage Effects 13116, Research Disclosure, Mar. 1975.

*Primary Examiner*—Charles L. Bowers, Jr.
*Assistant Examiner*—Geraldine Letscher
*Attorney, Agent, or Firm*—Gordon M. Stewart

[57] ABSTRACT

Photographic reversal elements, preferably color reversal elements, and methods of processing them, which elements use both an inhibitor releasing compound in a causer layer and fogged grains in the receiver layer to obtain a high interimage effect. The elements can be processed by standard processing (which provides for exhaustive color development). The elements have at least a first and a second layer, the first layer containing latent image forming iodide containing silver halide grains and the second layer containing latent image forming silver halide grains. An inhibitor releasing compound is provided in the first layer or a non-imaging layer associated with the first and second layers, the inhibitor releasing compound having the structural formula $$\text{CAR-(TIME)}_n\text{-INH}$$

wherein:

CAR is a carrier moiety from which -(TIME)$_n$-INH is released during-color development;

TIME is a timing group;

INH is comprised of a development inhibitor moiety; and n is 0, 1 or 2.

Surface fogged silver halide grains are provided in the second layer.

17 Claims, No Drawings

FOREIGN PATENT DOCUMENTS

| | | |
|---|---|---|
| 4200322 | 7/1993 | Germany . |
| 8002776 | 6/1974 | Japan . |
| 0170850 | 2/1984 | Japan . |
| 0170853 | 2/1984 | Japan . |
| 3139346 | 12/1984 | Japan . |
| 0170849 | 9/1985 | Japan . |
| 0170851 | 9/1985 | Japan . |
| 0170852 | 9/1985 | Japan . |
| 2148949 | 8/1986 | Japan . |
| 1004741 | 6/1987 | Japan . |
| 3304252 | 6/1987 | Japan . |
| 1068747 | 9/1987 | Japan . |
| 2222943 | 2/1989 | Japan . |
| 3153238 | 11/1989 | Japan . |
| 2-251950 | 10/1990 | Japan . |
| 1498876 | 1/1978 | United Kingdom . |

[METHOD OF PROCESSING] PHOTOGRAPHIC ELEMENTS HAVING FOGGED GRAINS AND DEVELOPMENT INHIBITORS FOR INTERIMAGE

FIELD OF THE INVENTION

This invention relates to photographic elements, particularly color reversal photographic elements, which contain both a selected development inhibitor releasing compound which is functional in standard color development, and fogged grains.

BACKGROUND OF THE INVENTION

Color photographic elements typically contain three records sensitive to regions of the spectrum corresponding to red, green and blue light. The records also contain dye forming compounds which are typically cyan in the red sensitive record, magenta in the green sensitive record and yellow in the blue sensitive record. The dyes are produced from the compounds during color development (the only color developer in color negative development, and the second developer in color reversal development). In order to accurately reproduce colors, each of the three records should ideally be sensitive only to light of one color and, in addition, the dye formed in each record should only absorb light of the same color to which the record is sensitive. However, the dyes typically also absorb some light of another color. For example, cyan dyes typically also absorb some green light.

Another defect in color reproduction arises because, during color development of the three color image-forming emulsion layers, the development of an image in one of the layers may cause unwanted formation of color in an adjacent emulsion layer intended by definition to record another image. For example, the development of the magenta image of the green-sensitive layer may cause formation of cyan dye in the red-sensitive layer, but following the pattern of the magenta image. This defect results from the fact that the oxidation products of development of one of the layers may diffuse to an adjacent layer where they would give rise to an unwanted coupling with the coupler present in this layer.

While development inhibitor releasing compounds ("DIR" compounds) in the form of couplers have been employed successfully in negative photographic elements to correct the above defects, they have met very limited success in reversal photographic elements. One of the reasons for this is that negative elements are only processed in a color developer to produce a negative dye image. On the other hand, reversal elements are first processed in a black and white developer followed by a fogging step, then a color developer. Currently, the standard process for processing reversal films,is by Kodak Process E-6 development described in more detail below, or substantially equivalent processes made available by other manufacturers. Such processes use exhaustive color development. As described by T. H. James, ed., *The Theory of the Photographic Process,* 4th Edition, Macmillan, New York, 1977, page 611, exhaustive color development results in DIR couplers having little effect in color reversal materials. Similarly, U.S. Pat. No. 4,788,132 states that the use of a DIR coupler in color reversal materials does not produce any substantial interimage effect since color development is hardly inhibited. While U.S. Pat. No. 4,729,943 describes the use of DIR couplers in color reversal elements, the DIR coupler is incorporated in a layer which does not take part in image formation and the color development time is reduced to between 1 and 2 minutes (that is, the development process is non-standard).

For purposes of this invention, conventional development processes include the E-6 process as described in *Manual For Processing Kodak Ektachrome Films Using E-6*, (1980) Eastman Kodak Company, Rochester, N.Y., Or a substantially equivalent process made available by a company other than Eastman Kodak Company, are referred to as "current" color reversal processes or "standard" processes. Current reversal processes employ as a color developer, 4-(N-ethyl-N-2-methylsulfonylaminoethylino)-2-methylphenylenediamine sesquisulfate, 1-hydrate in a concentration of from about 7 to about 11 grams per 1000 ml of water, and as a silver halide solvent, 2,2-ethylenedithioethanol (also known as Dithiaoctanediol) in a concentration of about 0.6 to about 1.2 grams per 1000 ml of water. The pH of the color developing agent is from about 11.6 to about 12.1. The color developing agent is used in the process for about from 5.5 to 7.0 minutes at a temperature of from 36.6 to 39.4 C.

It should be noted at this point that color reversal films have higher contrasts and shorter exposure latitudes than color negative film. Reversal films have a gamma generally between 1.5 and 2.0, and this is much higher than for negative materials. Moreover, such reversal films do not have masking couplers, and this further differentiates reversal from negative working films.

One method that has been particularly used in color reversal to obtain an interimage effect, is adjustment of the composition of halides, in particular iodide ion, used in different layers of the element. This produces an interimage effect during the black and white development step by action of the iodide ions released from the developing silver haloiodide emulsions. Another method described in U.S. Pat. No. 4,082,553 is the use of fogged grains in a receiver layer (a "receiver" layer being one which receives the interimage effect). However, the use of fogged grains requires additional silver laydown to compensate for reduced density which in turn reduces the effective speed of the record.

It would be desirable then to provide a means which provides high interimage effect, particularly in color reversal elements, and which allows a reversal element to be processed by standard processing methods but which does not solely rely on the use of fogged grains.

SUMMARY OF THE INVENTION

The present invention provides photographic elements, preferably reversal elements (which are preferably color reversal elements), with a combination of a DIR and fogged grains. It should be noted that the term "DIR" is used to include compounds which release inhibitors with timing groups (so called "DIAR"). This combination can produce a high inter-image effect without the speed loss associated with increased silver laydown required with fogged grains alone for the same effect, and without the same level of color density reduction which results from using a DIR alone to achieve the same effect. Particularly importantly, color reversal elements of the present invention can be processed by standard processing (for example, E-6) and still exhibit a high interimage effect.

The present invention therefore provides a reversal element (preferably a color reversal element) having the following:

a) at least a first and a second layer, the first layer containing latent image forming iodide containing silver halide grains and the second layer containing latent image forming silver halide grains; and b) an inhibitor releasing compound in the first layer or a non-imaging layer associated with the first and second layers, the inhibitor releasing compound having the structural formula $$\text{CAR-(TIME)}_n\text{-INH} \quad \text{(I)}$$

wherein:

CAR is a carrier moiety from which -(TIME)$_n$-INH is released during color development;

TIME is a timing group;

INH is comprised of a-development inhibitor moiety;

n is 0, 1 or 2; and c) surface fogged silver halide grains in the second layer.

The present invention also provides a method of processing color reversal elements of the foregoing type.

EMBODIMENTS OF THE INVENTION

It is preferred that reversal elements of the present invention have at least two light sensitive silver halide emulsion layers, and that the inhibitor containing compound is incorporated into one of those layers.

In an alternate, less preferred, embodiment of the present invention, a reversal photographic element of the present invention may use the development inhibitor compound and the fogged grains in the same layer. In particular, such a reversal photographic element would simply have an imaging layer with latent image forming iodide containing silver halide grains. That imaging layer, or a layer associated with the foregoing layer, would contain an inhibitor releasing compound of the type described above. This embodiment would also have the surface fogged silver halide grains preferably in the foregoing imaging layer. The imaging layer may optionally additionally contain non-iodide latent image forming silver halide grains. This embodiment of the invention is particularly applicable to a black and white reversal element having a single imaging layer (that is, only one layer forming an image).

The previously defined elements of the present invention may have each of the first and second layers, or both, color sensitized. Particularly those layers may be sensitized to different colors. It is particularly preferred that the first layer (often referred to as a "causer" layer in relation to interimage effects) is a red sensitized layer, and the second layer (often referred to as a "receiver" layer) is a green sensitized layer. It is also preferred that the first (red sensitized) and second (green sensitized) layers respectively contain a cyan and magenta dye forming coupler. In one arrangement, the first and second layers will be adjacent to one another or separated only by at least one non-imaging interlayer.

While the inhibitor releasing compound is preferably located in the first layer it may be located in another layer, for example a non-imaging interlayer between the first and second layers. Preferably, such a non-imaging layer does not contain any light sensitive silver halide. As to the size of the fogged silver halide grains, they will typically have an average mean particle size (that is, an average equivalent circular diameter of the projected area) of between 0.05 μm to 0.5 μm (preferably 0.05 μm to 0.2 μm), and in particular may be 0.15 μm. The fogged grains may be of any silver halide, and preferably have an iodide content of from 0 to 12% (by moles of silver). Any shape of grains may be used. The amount of fogged grains that is used is typically between 0.5% to 10% (preferably 0.5% to 7.5%; and more preferably will be no more than 5%) by weight of the imaging silver halide in the receiver record. When the fogged grains are in a non-imaging interlayer the amount would typically be 0.001 to 0.20 g/m$^2$, and preferably between 0.01 to 0.10 g/m$^2$ (and more preferably 0.01 to 0.05 g/m$^2$). All of the foregoing percentage figures refer to mole percentage (based on moles of silver in the fogged grains to total moles of imaging silver in the same layer, or in the case of the fogged grains being in a non-imaging interlayer, the total moles of silver in the receiving layer).

The surface-fogged silver halide emulsion can be prepared by adding a reducing agent or a gold salt to an emulsion capable of forming a surface latent image under appropriate pH and pAg conditions, heating an emulsion capable of forming a surface latent image under a low pAg condition, or uniformly exposing an emulsion capable of forming a surface latent image to light. Examples of suitable reducing agents are stannous chloride, hydrazine compounds, and ethanolamine. The grains are preferably surface fogged by heating at high pH and low pAg.

In one preferred arrangement of the present invention, the second color layer comprises at least two sub-layers each with silver halide grains having the same spectral response but of differing sensitivities. That is, the second layer has both fast and slow sub-layers. In this arrangement it is preferred that the sub-layer of the lower sensitivity (slow sub-layer) be closer to the first color record so that the slow layer receives the maximum interimage effect.

In color reversal elements and other elements, it is preferred that the inhibitor releasing compound be a "strong inhibitor", that is it has an inhibitor strength greater than 1. The inhibitor moiety, INH, may particularly be an oxazole, thiazole, diazole, oxadiazole, oxathiazole, triazole, thiatriazole, benzotriazole, tetrazole, benzimidazole, indazole, isoindazole, mercaptotriazole, mercaptothiadiazole, mercaptotetrazole, selenotetrazole, mercaptothiazole, selenobenzothiazole, mercaptobenzoxazole, selenobenzoxazole, mercaptobenzimidazole, selenobenzimidazole, benzodiazole, mercaptooxadiazole, or benzisodiazole.

The method of processing a color reversal element of the present invention comprises first treating the element with a black and white developer to develop exposed silver halide grains. The element is then treated with a color developer. Such developing process is preferably a standard process (particularly the E-6 process) as described above.

The present invention provides for the use of fogged grains particularly in conjunction with inhibitor or inhibitor fragments, which are preferably strong inhibitor or inhibitor fragments.

As to the use of strong inhibitors, although not bound by any theory, it is believed that the strong inhibitors or inhibitor fragments released during the color reversal process is a color development inhibitor which is sufficiently strong to allow image modification that results in increased sharpness to take place and improved color reproduction, increasing saturation in one color without substantially increasing color saturation in a similar color, for example, saturating reds while not substantially saturating flesh color and thus maintaining more accurate reproduction of flesh color. That is, the inhibitors have to be selected carefully to obtain the improved image modification.

Thus, the very strong inhibitor fragments released by compounds which may be employed in this invention enable the use of the E-6 type development process with such DIR compounds or couplers with desirable image modifying advantages.

The inhibitor number, IN, of the INH compound is defined as:

$$IN = \frac{D_{max}\text{ (solution } A) - D_{max}\text{ (solution } B)}{D_{max}\text{ (solution } A)} \times 100$$

wherein IN is greater than 35 and is preferably greater than 50 with a typical IN being about 60.

The inhibitor strength, IS (also referenced as inhibitor potency in this application), of the INH compound is defined as:

$$IS = \frac{IN_{(test)}}{IN_{(control)}}$$

where $IN_{(test)}$ is the inhibitor number determined by the method described above for any INH compound of interest, and $IN_{(control)}$ is the inhibitor number determined for the test coating when 1-phenyl-5-mercapto-1,2,3,4-tetrazole is the INH compound incorporated into the color developer. In the compounds preferably used in present invention, IS is equal to or greater than 1 (one) and is preferably greater than 1.2 with a typical IS being about 1.6.

It has been found that compounds having the structural formula $$\text{CAR-(TIME)}_n\text{-INH}$$

wherein INH comprises a compound that has a inhibitor strength greater than 1 provide particularly desirable results when incorporated into color reversal photographic elements.

DIR compounds can be employed in the color reversal photographic element of the invention, preferably in the cyan dye-forming unit, and more preferably in a fast red-sensitive silver halide layer in said cyan dye-forming unit. Such development inhibitors useful in the invention are disclosed in U.S. Pat. No. 5,151,343, incorporated herein by reference. Mercaptotetrazole and mercaptooxadiazole inhibitors are especially preferred.

Linking or timing groups, when present, are groups such as esters, carbamates, and the like that undergo base-catalyzed cleavage, including anchimerically assisted hydrolysis or intramolecular nucleophilic displacement. Suitable linking groups, which are also known as timing groups, are shown in the previously mentioned U.S. Pat. No. 5,151,343 and in U.S. Pat. Nos. 4,857,447, 5,021,322, 5,026,628, and the previously mentioned 5,051,345, all incorporated herein by reference. Preferred linking groups are p-hydroxymethylene moieties, as illustrated in the previously mentioned U.S. Pat. No. 5,151,343 and in Coupler DIR-1 of the instant application, and o-hydroxyphenyl substituted carbamate groups.

CAR groups includes couplers which react with oxidized color developer to form dyes while simultaneously releasing development inhibitors or inhibitor precursors. Other suitable carrier groups include hydroquinones, catechols, aminophenols, aminonaphthols, sulfonamidophenols, pyrogallols, sulfonamidonaphthols, and hydrazides that undergo cross-oxidation by oxidized color developers. DIR compounds with carriers of these types are disclosed in U.S. Pat. No. 4,791,049, incorporated herein by reference. Preferred CAR groups are couplers that yield unballasted dyes which are removed from the photographic element during processing, such as those disclosed in the previously mentioned U.S. Pat. No. 5,151,343. Further, preferred carrier groups are couplers that yield ballasted dyes which match spectral absorption characteristics of the image dye and couplers that form colorless products.

In one embodiment of the invention, a three-color reversal element has the following schematic structure:

(13) Second protective layer containing matte
(12) First protective layer containing UV-absorbing dyes
(11) Fast blue-sensitive layer containing blue-sensitive emulsion and yellow coupler
(10) Slow blue-sensitive layer containing blue-sensitive emulsion and yellow coupler
(9) Yellow filter layer
(8) Intermediate layer
(7) Fast green-sensitive layer containing green-sensitive emulsion and magenta coupler
(6) Slow green-sensitive layer containing green-sensitive emulsion and magenta coupler
(5) Intermediate layer
(4) Fast red-sensitive layer containing red-sensitive emulsion and cyan coupler
(3) Slow red-sensitive layer containing red-sensitive emulsion and cyan coupler
(2) Intermediate layer
(1) Antihalation layer Support with subbing layer In the following discussion of suitable materials for use in the emulsions and elements of this invention, reference will be made to *Research Disclosure*, December, 1989, Item 308119, published by Kenneth Mason Publications, Ltd., Dudley Annex, 12a North Street, Emsworth, Hampshire, P010 7DQ, UK, the disclosures of which are incorporated herein by reference. This publication will be identified hereafter by the term Research Disclosure.

Couplers which form cyan dyes upon reaction with oxidized color-developing agents are described in such representative patents and publications as U.S. Pat. Nos. 2,772,162; 2,895,826; 3,002,836; 3,034,892; 2,747,293; 2,423,730; 2,367,531; 3,041,236; and 4,333,999; and Research Disclosure, Section VII D. Preferably, such couplers are phenols and naphthols.

Couplers which form magenta dyes upon reaction with oxidized color developing agents are described in such representative patents and publications as: U.S. Pat. Nos. 2,600,788; 2,369,489; 2,343,703; 2,311,082; 3,152,896; 3,519,429; 3,062,653; and 2,908,573; and Research Disclosure, Section VII D. Preferably, such couplers are pyrazolones and pyrazolotriazoles.

Couplers which form yellow dyes upon reaction with oxidized and color developing agents are described in such representative patents and publications as: U.S.

Pat. Nos. 2,875,057; 2,407,210; 3,265,506; 2,298,443; 3,048,194; and 3,447,928; and Research Disclosures, Section VII D. Preferably, such couplers are acylacetamides such as benzoylacetanilides and pivaloylacetanilides.

Couplers which form colorless products upon reaction with oxidized color developing agents are described in such representative patents as: UK Patent No. 861,138; U.S. Pat. Nos. 3,632,345; 3,928,041; 3,958,993; and 3,961,959. Preferably, such couplers are cyclic carbonyl-containing compounds which react with oxidized color developing agents but do not form dyes.

The image dye-forming couplers can be incorporated in photographic elements and/or in photographic processing solutions, such as developer solutions, so that upon development of an exposed photographic element they will be in reactive association with oxidized color-developing agent. Coupler compounds incorporated in photographic processing solutions should be of such molecular size and configuration that they will diffuse through photographic layers with the processing solution. When incorporated in a photographic element, as a general rule, the image dye-forming couplers should be nondiffusible; that is, they should be of such molecular size and configuration that they will not significantly wander from the layer in which they are coated.

Photographic elements of this invention can be processed by conventional techniques in which color-forming couplers and color-developing agents are incorporated in separate processing solutions or compositions or in the element, as described in Research Disclosure, Section XIX.

The strong inhibitor releasing DIR compounds described above are highly desirable because they generate more interimage at higher densities than lower densities. That is, such DIR compounds which are preferably used in this invention have the effect of reproducing certain colors or high relative chroma, e.g. reds, while enabling reproduction of related colors, e.g. flesh colors, with less relative increase in saturation or chroma when used in a color image forming layer or in a non-color image forming layer.

Preferred INH groups of the above compounds can be selected from the group having the following structures:

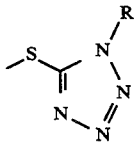

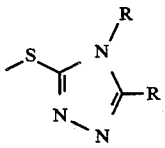

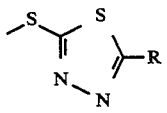

-continued

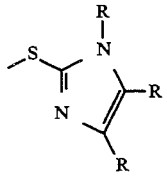

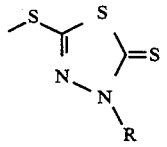

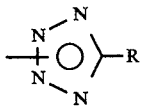

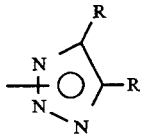

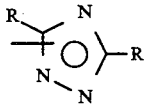

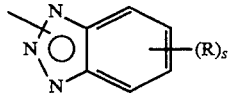

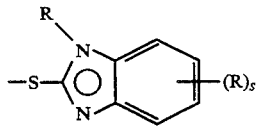

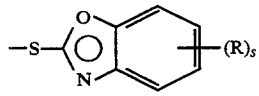

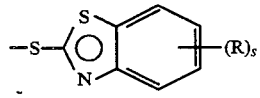

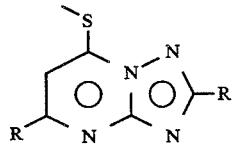

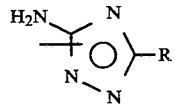

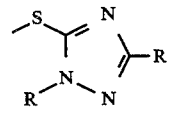

-continued

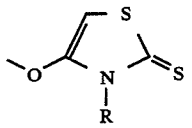

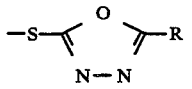

wherein R is an alkyl group, hydrogen, halogen (including fluorine, chlorine, bromine and iodine), an aryl group, or a 5- or 6-membered heterocyclic ring, alkoxy group, aryloxy group, alkoxycarbonyl group, aryloxycarbonyl group, amino group, sulfamoyl group, sulfonamido group, sulfoxyl group carbamoyl group, alkylsulfo group, arylsulfo group, hydroxy group, aryloxycarbonylamino group, alkoxycarbonylamino group, acylamino group, ureido group, arylthio group, alkylthio group, cyano group. When R is an alkyl group, the alkyl group may be substituted or unsubstituted or straight or branched chain or cyclic. The total number of carbons in R is 0 to 25. The alkyl group may in turn be substituted by the same groups listed for R. The R group may also contain from 1 to 5 thioether moieties in each of which the sulfur atom is directly bonded to a saturated carbon atom. When the R group is an aryl group, the aryl group may be substituted by the same groups listed for R. When R is a heterocyclic group, the heterocyclic group is a 5- or 6-membered monocyclic or condensed ring containing as a heteroatom a nitrogen atom, oxygen atom, or a sulfur atom. Examples are a pyridyl group, a quinolyl group, a furyl group, a benzothiazolyl group, an oxazolyl group, an imidazolyl group, a thiazolyl group, a triazolyl group, a benzotriazolyl group, an imido group and an oxazine group. When there is one or more R groups on a molecule R may be the same of different. and is 1 to 4.

Further preferred INH groups are selected from the following the structures:

INH-1

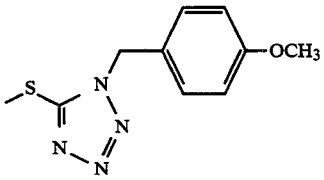

INH-2

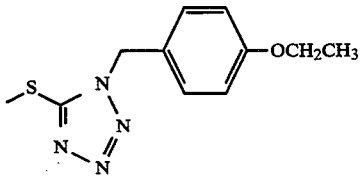

INH-3

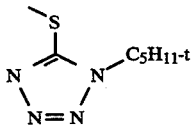

-continued

INH-4

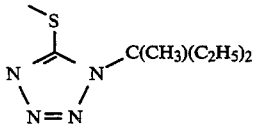

INH-5

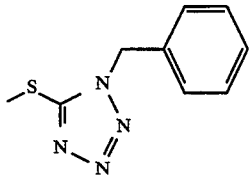

INH-6

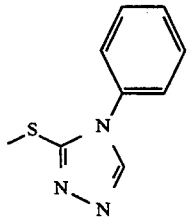

INH-7

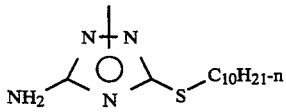

INH-8

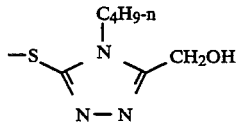

INH-9

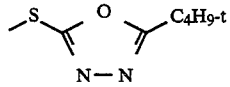

INH 10

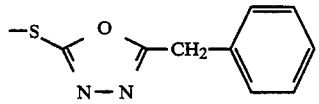

INH 11

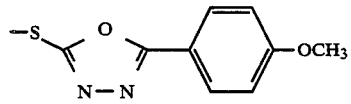

INH 12

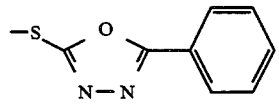

INH 13

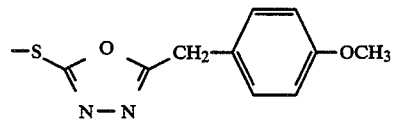

-continued

INH-14

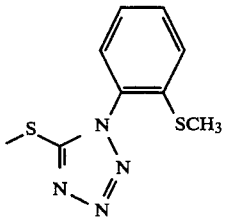

INH-15

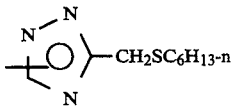

INH-16

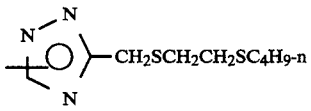

INH-17

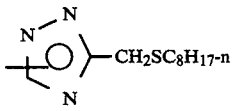

INH-18

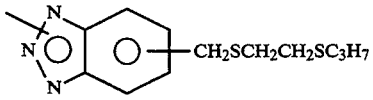

INH-19

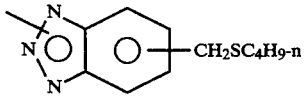

INH-20

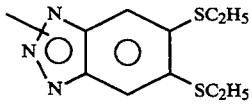

INH-21

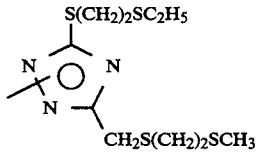

INH-22

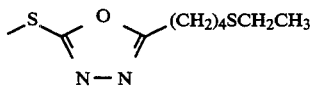

Preferably CAR is a coupler moiety and further the coupler moiety may be ballasted.

In the element in accordance with the invention the -(TIME)$_n$-INH group can be bonded to a coupling position of the coupler moiety.

Preferably CAR is unballasted and at least one TIME moiety attached to CAR is ballasted and CAR is preferably a coupler moiety.

Further, preferably CAR is a moiety which can cross-oxidize with oxidized color developer, and may be selected from the class consisting of hydrazides and hydroquinones.

The compound (I) may be present in the element from 0.5 to about 30 mg/ft$^2$ (0.005 to 0.3 g/m$^2$)and typically is present in the element from about 1 to about 10 mg/ft$^2$ (0.01 to 0.1 g/m$^2$).

CAR can, for example, be a coupler residue, designated COUP, which forms a dye as a part of a coupling reaction, or an organic residue which forms no dye. The purpose of CAR is to furnish, as a function of color development, a fragment INH, or INH linked to a linking group or timing group or to a combination of linking and timing groups, designated -(TIME)$_n$-. So long as it performs that function in an efficient manner, it has accomplished its purpose of a preferably strong inhibitor releasing DIR. It will be noted that when a highly active CAR is used the INH strength can be less than 1 (one) because the reactivity of the active CAR is sufficient to release the INH at an early time of development to provide desired interimage and sharpness effects.

When COUP is a yellow coupler residue, coupler residues having general formulas II–IV are preferred. When COUP is a magenta coupler residue, it is preferred that COUP have formula (V) or (VIII). When COUP is a cyan coupler residue, it is preferred that COUP have the formula represented by general formulas (VI) and (VII).

Furthermore, CAR may be a redox residue, which is a group capable of being cross oxidized with an oxidation product of a developing agent. Such carries may be hydroquinones, catechols, pyrogallols, aminonaphthols, aminophenols, naphthohydroquinones, sulfonamidophenols, hydrazides, and the like. Compounds with carriers of these types are disclosed in U.S. Pat. No. 4,791,049. Preferred CAR fragments of this type are represented by general formulas (X) and (XI). The amino groups included therein are preferably substituted with $R_{10}$ which is a sulfonyl group having one to 25 carbon atoms, or an acyl group having 1–25 carbon atoms; the alkyl moieties in these groups can be substituted. Compounds within formulas (IX) and (XII) are compounds that react with oxidized developer to form a colorless product or a dye which decolorizes by further reaction.

It is to be understood that elements of the present invention may have one or two or more described image modifying compounds in an image forming silver halide emulsion layer, or that two or more such layers may have one or more described image modifying compounds. Of course, the present invention is not limited to the described strong inhibitor releasing image modifying compounds, it being possible to use the fogged grains with a development inhibitor releasing compounds in which INH has an inhibitor strength less than or equal to 1 (although this is less desirable).

In general compound (I) is represented by, for example, the following structures:

II

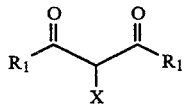

III

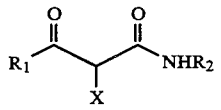

IV

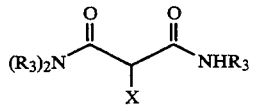

-continued

V

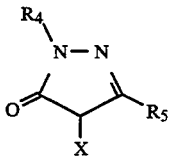

VI

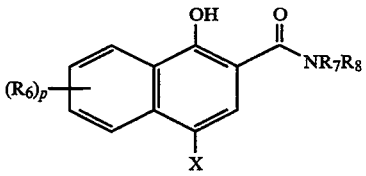

VII

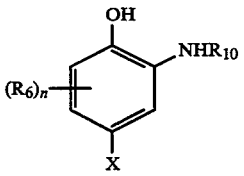

VIII

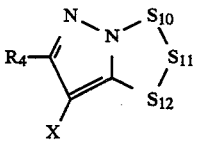

IX

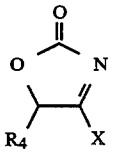

X

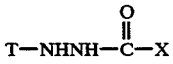

XI

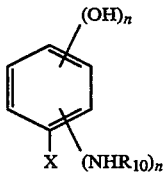

XII

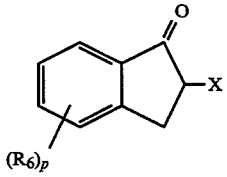

In the foregoing compounds, X=-(TIME)$_n$-INH, and $R_1$ represents an aliphatic group, an aromatic group, an alkoxy group, or a heterocyclic ring, and $R_2$ and $R_3$ are each an aromatic group, an aliphatic group or a heterocyclic ring. The aliphatic group represented by $R_1$ preferably contains from 1 to 30 carbon atoms, and may be substituted or unsubstituted, straight or branched chain, or cyclic. Preferred substituents for an alkyl group include an alkoxy group, an aryloxy group, an amino group, an acylamino group, and a halogen atom. These substituents per se may be substituted. Suitable examples of aliphatic groups represented by $R_1$, $R_2$ and $R_3$ are as follows: an isopropyl group, an isobutyl group a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido)isopropyl group, an α-(phthalimido)-isopropyl group, and an α-(benzenesulfonamido)isopropyl group. When two $R_1$ or $R_3$ groups appear, they may be alike or different.

When $R_1$, $R_2$ or $R_3$ represents an aromatic group (particularly a phenyl group), the aromatic group may be substituted or unsubstituted. That is, the phenyl group can be employed per se or may be substituted by a group containing 32 or less carbon atoms, e.g., an alkyl group, an alkenyl group, an alkoxy group, an alkoxycarbonyl group, an alkoxycarbonylamino group, an aliphatic amido group, an alkylsulfamoyl group, an alkylsulfonamido group, an acylureido group, and an alkyl-substituted succinimido group. This alkyl group may contain an aromatic group, e.g., phenylene, in the chain thereof. The phenyl group may also be substituted by, e.g., an aryloxy group, an aryloxycarbonyl group, an arylcarbamoyl group, an arylamido group, an arylsulfamoyl group, an arylsulfonamido group, or an arylureido group. In these subtituents, the aryl group portion may be further substituted by at least one alkyl group containing from 1 to 22 carbon atoms in total.

The phenyl group represented by $R_1$, $R_2$, or $R_3$ may be substituted by an amino group which may be further substituted by a lower alkyl group containing from 1 to 6 carbon atoms, a hydroxyl group, a carboxyl group, a sulfo group, a nitro group, a cyano group, a thiocyano group, or a halogen atom.

In addition, $R_1$, $R_2$ or $R_3$ may further represent a substituent resulting from condensation of a phenyl group with another ring, e.g., a naphthyl group, a quinolyl group, an isoquinolyl group, a furanyl group, a cumaranyl group, and a tetrahydronaphthyl group. These substituents per se may be further substituted.

When $R_1$ represents an alkoxy group, the alkyl portion of the alkoxy group contains from 1 to 40 carbon atoms and preferably from 1 to 22 carbon atoms, and is a straight or branched alkyl group, a straight or branched alkenyl group, a cyclic alkyl group, or a cyclic alkenyl group. These groups may be substituted by, e.g., a halogen atom, an aryl group or an alkoxy group.

When $R_1$, $R_2$ or $R_3$ represents a heterocyclic ring, the heterocyclic ring is bound through one of the carbon atoms in the ring to the carbon atom of the carbonyl group of the acyl group in α-acylacetamide, or to the nitrogen atom of the amido group in α-acylacetamide. Examples of such heterocyclic rings are thiophene, furan, pyran, pyrrole, pyrazole, pyridine, piperidine, pyrimidine, pyridazine, indolizine, imidazole, thiazole, oxazole, triazine, thiazine and oxazine. These heterocyclic rings may have a substituent on the ring thereof.

In structure (V), $R_4$ contains from 1 to 40 carbon atoms, preferably from 1 to 30 carbon atoms, and is a straight or branched alkyl group (e.g., methyl, isopropyl, tert-butyl, hexyl and dodecyl), an alkenyl group (e.g., an allyl group), a cyclic alkyl group (e.g., a cyclopentyl group, a cyclohexyl group and a norbornyl group), an aralkyl group (e g., a benzyl group and a β-phenylethyl group), or a cyclic alkenyl group (e.g., a cyclopentenyl group and a cyclohexenyl group). These groups may be substituted by, e.g., a halogen atom, a nitro group, a cyano group, an aryl group, an alkoxy group, an aryloxy group, a carboxyl group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxyl group and a mercapto group.

$R_4$ may further represent an aryl group, e.g. a phenyl group, and an α- or β-naphthyl group. This aryl group contains at least one substituent. These substituents include an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxyl group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxyl group and a mercapto group.

More preferably, $R_4$, is a phenyl group which is substituted by, e.g., an alkyl group, an alkoxy group or a halogen atom, in at least one of the ortho positions.

$R_4$ may further represent a heterocyclic ring (e.g., 5- or 6-membered heterocyclic or condensed heterocyclic group containing a nitrogen atom, an oxygen atom or a sulfur atom as a hetero atom, such as a pyridyl group, a quinolyl group, a furyl group, a benzothiazolyl group, an oxazolyl group, an imidazolyl group and a naphthoxazolyl group), a heterocyclic ring substituted by the groups described for the aryl group as described above, an aliphatic or aromatic acyl group, an alkylsulfonyl group, an arylsulfonyl group, an alkylcarbamoyl group, an arylcarbamoyl group, an alkylthiocarbamoyl group or an arylthiocarbamoyl group.

$R_5$ is a hydrogen atom, a straight or branched alkyl group containing from 1 to 40 carbon atoms, preferably from 1 to 30 carbon atoms, an alkenyl group, a cyclic alkyl group, an aralkyl group, a cyclic alkenyl group to which may contain substituents as described for $R_4$), an aryl group and a heterocyclic group (which may contain substituents as described for $R_4$,), an alkoxycarbonyl group (e.g., a methoxycarbonyl group, an ethoxycarbonyl group and a stearyloxycarbonyl group), an aryloxycarbonyl group (e.g., a phenoxycarbonyl group, and a naphthoxycarbonyl group), an aralkyloxycarbonyl group (e.g., a benzyloxycarbonyl group), an alkoxy group (e.g., a methoxy group, an ethoxy group and a heptadecyloxy group), an aryloxy group (e.g., a phenoxy group and a tolyloxy group), an alkylthio group (e.g., an ethylthio group, and a dodecylthio group), an arylthio group (e.g., a phenylthio group and an α-naphthylthio group), a carboxyl group, an acylamino group (e.g., an acetylamino group and a 3-[(2,4-di-tert-amylphenoxy)acetamido]benzamido group), a diacylamino group, an N-alkylacylamino group (e.g., an N-methylproprionamido group), an N-arylacylamino group (e.g., an N-phenylacetamido group), a ureido group (e.g. a ureido group and an N-arylureido group), a urethane group, a thiourethane group, an arylamino group (e.g., a phenylamino group, an N-methylanilino group, a diphenylamino group, an N-acetylanilino group and a 2-chloro-5-tetradecanamidoanilino group), a dialkylamino group (e.g., a dibenzylamino group), an alkylamino group (e.g., an n-butylamino group, a methylamino group and a cyclohexylamino group), a cycloamino group (e.g., a piperidino group and a pyrrolidino group), a heterocyclic amino group (e.g., a 4-piperidylamino group and a 2-benzoxazolylamino group), an alkylcarbonyl group (e.g., a methylcarbonyl group), an arylcarbonyl group (e.g., a phenylcarbonyl group), a sulfonamido group (e.g., an alkylsulfonamido group, and an arylsulfonamido group), a carbamoyl group (e.g., an ethylcarbamoyl group, a dimethylcarbamoyl group, an N-methylphenylcarbamoyl group, and an N-phenylcarbamoyl group), a 4,4'-sulfonyldiphenoxy group, a sulfamoyl group (e.g., an N-alkylsulfamoyl group, an N,N-dialkylsulfamoyl group, an N-arylsulfamoyl group, an N-alkyl-N-arylsulfamoyl group and an N,N-diarylsulfamoyl group), a cyano group, a hydroxyl group, a mercapto group, a halogen atom or a sulfo group.

$R_6$, $R_7$ and $R_8$ each represents groups as used for the usual 4-equivalent type phenol or α-naphthol couplers. In greater detail, $R_6$ is a hydrogen atom, a halogen atom, an aliphatic hydrocarbon residue, an acylamino group, —O—$R_9$ or —S—$R_9$ (wherein $R_9$ is an aliphatic hydrocarbon residue). When there are two or more $R_6$ groups in the same molecule, they may be different. The aliphatic hydrocarbon residue includes those containing a substituent(s). $R_7$ and $R_8$ are each an aliphatic hydrocarbon residue, an aryl group or a heterocyclic residue. One of $R_7$ and $R_8$ may be a hydrogen atom, and the above-described groups for $R_7$ and $R_8$ may be substituted. $R_7$ and $R_8$ may combine together to form a nitrogen-containing heterocyclic nucleus. In the formulas, n is an integer of from 1 to 3, and p is an integer of from 1 to 5.

$R_{11}$ group refers to a hydrogen atom, a halogen atom, an alkyl group, an alkenyl group, an aralkyl group, an alkoxy group, an alkoxycarbonyl group, an anilino group, an acylamino group, a ureido group, a cyano group, a nitro group, a sulfonamido group, a sulfamoyl group, a carbamoyl group, an aryl group, a carboxy group, a sulfo group, a hydroxy group, or an alkanosulfonyl group. The alkyl group on $R_{11}$ contains 1 to 32 carbons. In the general formulae X–XXII, Z is oxygen, nitrogen, or sulfur, and k is an integer of 0 to 2.

$R_{10}$ is an acylamido group represented by $COR_1$, a carbamoyl group represented by $CONHR_7R_8$, a sulfonamido group represented by $SO_2R_1$, or a $SO_2NR_7R_8$.

The aliphatic hydrocarbon residue may be saturated or unsaturated, straight, branched or cyclic. Preferred examples are an alkyl group (e.g., a methyl group, an ethyl group, a propyl group, an isopropyl group, a butyl group, a tert-butyl group, an isobutyl group, a dodecyl group, an octadecyl group, a cyclobutyl group, and a cyclohexyl group), and an alkenyl group (e.g., an allyl group, and an octenyl group).

The aryl group includes a phenyl group and a naphthyl group, and typical examples of heterocyclic residues are a pyridinyl group, a quinolyl group, a thienyl group, a piperidyl group and an imidazolyl group. Substituents which may be introduced to these aliphatic hydrocarbon, aryl, and heterocyclic groups include a halogen atom, a nitro group, a hydroxyl group, a carboxyl group, an amino group, a substituted amino group, a sulfo group, an alkyl group, an alkenyl group, an aryl group, a heterocyclic group, an alkoxy group, an aryloxy group, an arylthio group, an arylazo group, an acylamino group, a carbamoyl group, an ester group, an acyl group, an acyloxy group, a sulfonamido group, a sulfamoyl group, a sulfonyl group and a morpholino group.

In compounds (II) to (XXII), the substituents, $R_1$, $R_2$, $R_3$, $R_4$, $R_5$, $R_6$, $R_7$ and $R_8$ may combine together to form symmetrical or asymmetrical composite couplers, or any of the substituents may become a divalent group to form symmetrical or asymmetrical composite couplers.

In compounds VIII: $S_{10}$, $S_{11}$ and $S_{12}$ each represents a methine, a substituted methine, =N—, or —NH—; one of $S_{10}$–$S_{11}$ bond and $S_{11}$–$S_{12}$ bond is a double bond and the other is a single bond; when $S_{11}$–$S_{12}$ is a carbon-carbon double bond, the double bond may be a part of an aromatic ring; the compound of general formula VIII includes the case that it forms a dimer or higher polymer at $R_4$; and also when $S_{10}$, $S_{11}$ or $S_{12}$ is a substituted methine, the compound includes the case that it forms a dimer or higher polymer with the substituted methine. Polymer formation can also take place through the linking group -(TIME)$_n$- in all image modifying compounds employed in this invention.

If $R_1$ through $R_{10}$ of structures II through VIII are a ballast such that the dye which is formed on reaction with oxidized developer remains in the film after processing then the formulae are represented by Type II examples.

Especially preferred are those couplers which undergo a coupling reaction with an oxidation product of a developing agent, releasing a development inhibitor, but do not leave a dye in the film which could cause degradation of the color quality. If $R_1$ through $R_{10}$ of compounds II through VIII are not a ballast such that the subsequent dye formed from CAR is not immobilized, and is removed from the film during processing, then the formulae are represented by Type I examples. Also included in these Type I examples are formulae IX, X, XI and XII in which $R_1$ through $R_8$ do represent a ballast, but CAR either forms a colorless product or doesn't form a dye on reaction with oxidized developer (as in the case with compounds XI and XII) or the dye that is formed is decolorized by subsequent reactions in the process (as is the case with compounds IX and XII).

Also preferred structures which would produce the same effects as DIR couplers without leaving a retained dye in the film are those in which CAR is a material capable of undergoing a redox reaction with the oxidized product of a developing agent and subsequently releasing a development inhibitor as described in U.S. Pat. No. 4,684,604 and represented by the compound X where T represents a substituted aryl group. T may be represented by phenyl, naphthyl; and heterocyclic aryl rings (e.g. pyridyl) and may be substituted by one or more groups such as alkoxy, alkyl, aryl, halogen, and those groups described as $R_5$.

$R_{10}$ is selected from alkyl or aryl sulfonyl groups and alkyl and aryl carbonyl groups In the compounds (I), -(TIME)$_n$-INH is a group which is not released until after reaction with the oxidized developing agent either through cross oxidization or dye formation.

-(TIME)$_n$- in the compounds (I) is one or more linking or timing groups connected to CAR through a oxygen atom, a nitrogen atom, or a sulfur atom which is capable of releasing INH from -(TIME)$_n$-INH at the time of development through one or more reaction stages. Suitable examples of these types of groups are found in U.S. Pat. Nos. 4,248,962, 4,409,323, 4,146,396, British Pat. No. 2,096,783, Japanese Patent Application (Opi) Nos. 146828/76 and 56837/82, etc.

Preferred examples of -(TIME)- are those represented by the following examples XIII–XX:

XIII

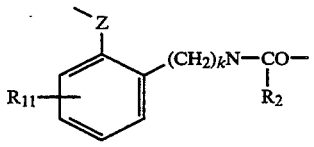

XIV

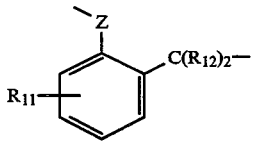

XV

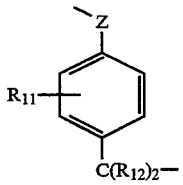

XVI

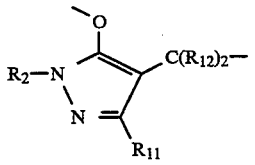

XVII

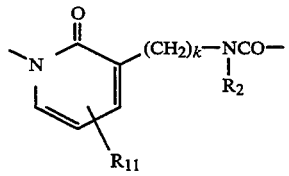

XVIII

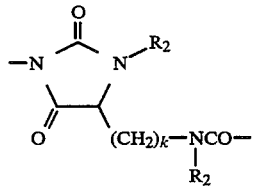

XIX

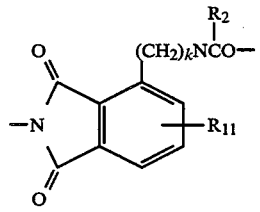

XX

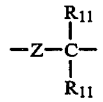

In each of the foregoing compounds, the bond on the left is attached to either CAR or another -(TIME)- moiety, and the bond to the right is attached to INH.

$R_{12}$ is hydrogen, alkyl, perfluoroalkyl, alkoxy, alkylthio, aryl, aryloxy, arylthio, $(R_2)_2N$-, $R_1CONR_7$-, or heterocyclic; $(R_{12})_2$ can complete a non-aromatic heterocyclic or a non-aromatic carbocyclic ring, and $R_{12}$ and $R_{11}$ can complete a non-aromatic heterocyclic or non-aromatic carbocyclic ring.

In timing groups XIII, XIV, XV, and XVII, $R_{11}$ can complete a carbocyclic or heterocyclic ring or ring system. Rings completed include derivatives of naphthalene, quinoline, and the like.

When n=0, $-(TIME)_n-$ also represents a single bond such that CAR may be directly joined to INH.

For n=2, there can be a combination of any two timing groups mentioned in formulas XIII to XX which still allows the fragmentation and release of INH during color development after CAR has reacted with the oxidized developer. The combination of two timing groups may be used to improve the release of the inhibitor fragment INH either through rate of release and/or diffusability of $-(TIME)_n$-INH or any of its subsequent fragments. For example, preferred structures are:

XXI

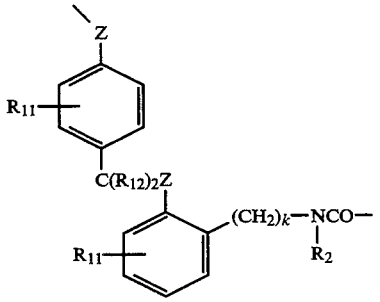

XXII

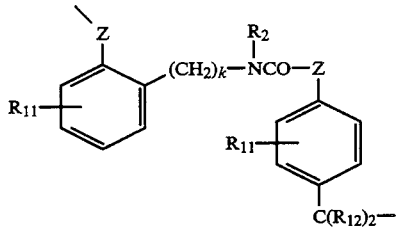

XXIII

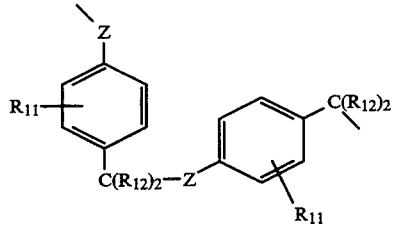

-continued

XXIV

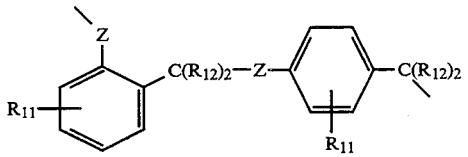

XV

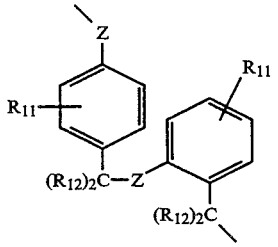

XXVI

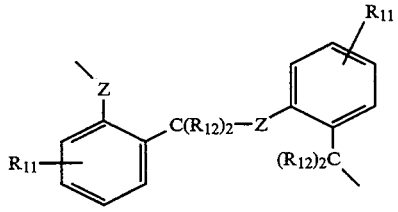

Naphtholic DIR couplers as described can be prepared by reactions and methods known in the organic compound synthesis art. Similar reactions and methods are described in U.S. Pat. No. 4,482,629.

Methods of synthesising naptholic couplers are also described in U.S. Patent Application for "Image Formation In Color Reversal Materials Using Strong Inhibitors", Attorney Docket No. 66553, by Burns et al. filed on the same date as the present application, and any of the DIRs of that invention can be used in the present invention. The foregoing application is incorporated by reference in the present application. Photographic elements described therein are useful in the present invention provided that the fogged grains required by the present invention are additionally present in such elements. For this invention, the image modifying compound of the type described above is preferably present in a silver halide layer which contributes to image formation by substantial formation of a dye. It is preferred that the image modifying compound be present in an amount of from about 0.5 to about 30 mg/ft$^2$ (0.0054 to 0.323 g/m$^2$ of the reversal color material, e.g. film; more preferably, from 1 to about 10 mg/ft$^2$ (0.01 to 0.108 g/m$^2$).

Illustrative but not limiting image modifying compounds which can be employed in this invention appear below:

DIR-1
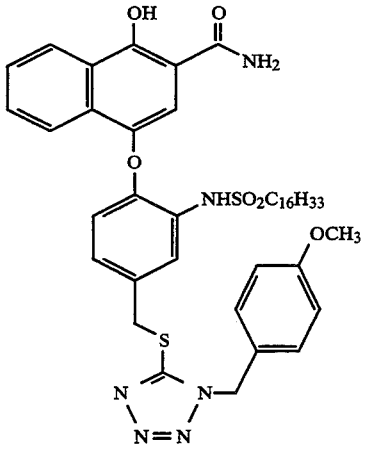
DIR-2
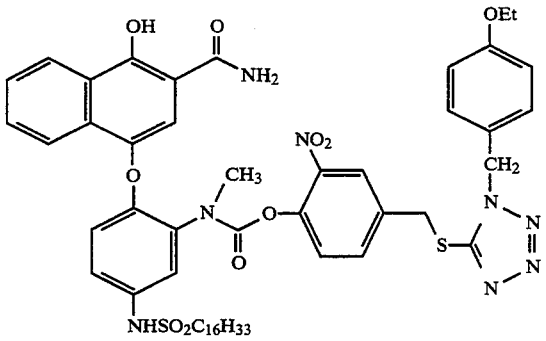
DIR-3
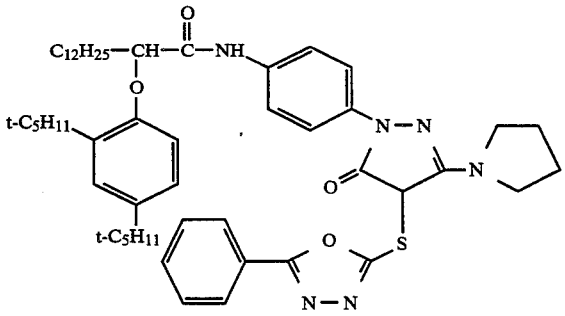
DIR-4
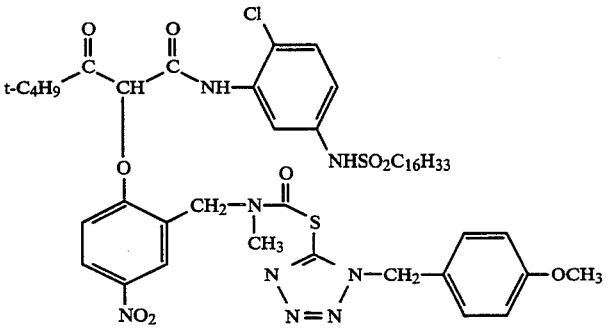
DIR-5
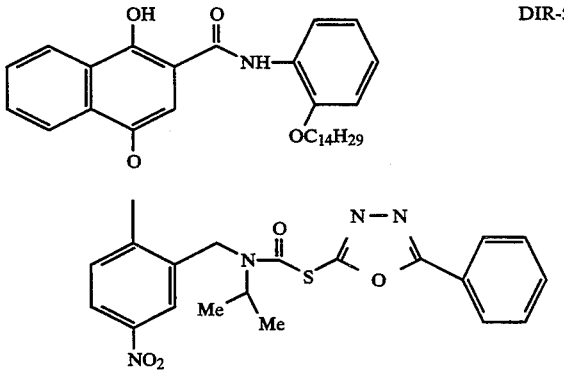
DIR-6
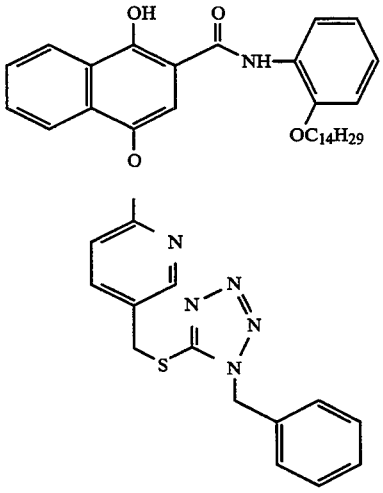

-continued
DIR-7
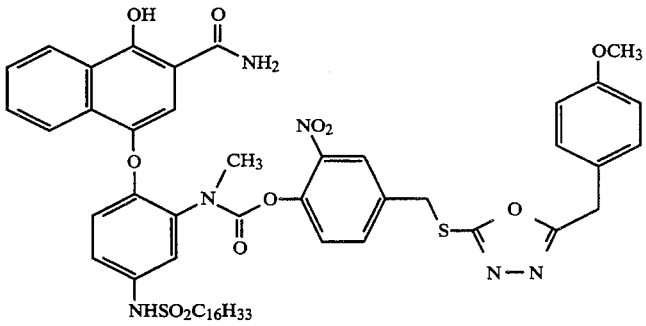
DIR-8
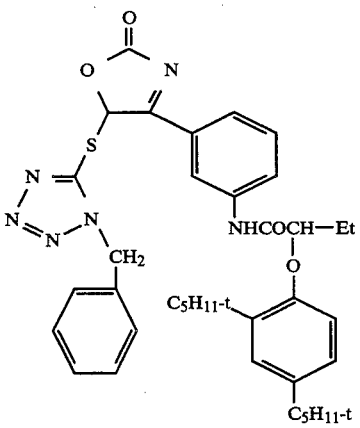
DIR-9
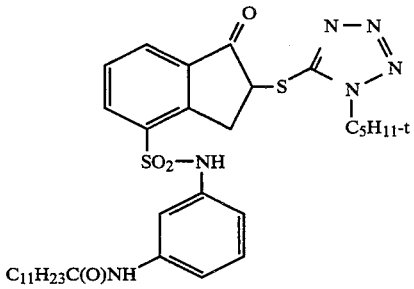
DIR-10
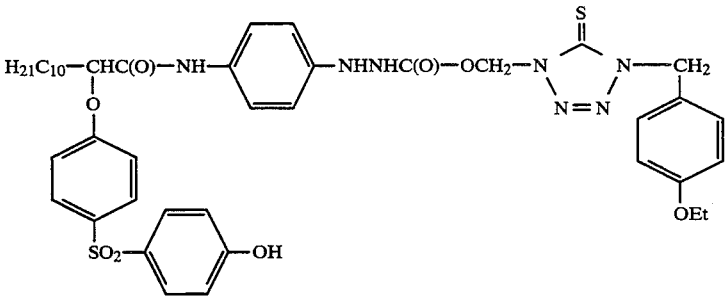
DIR-11
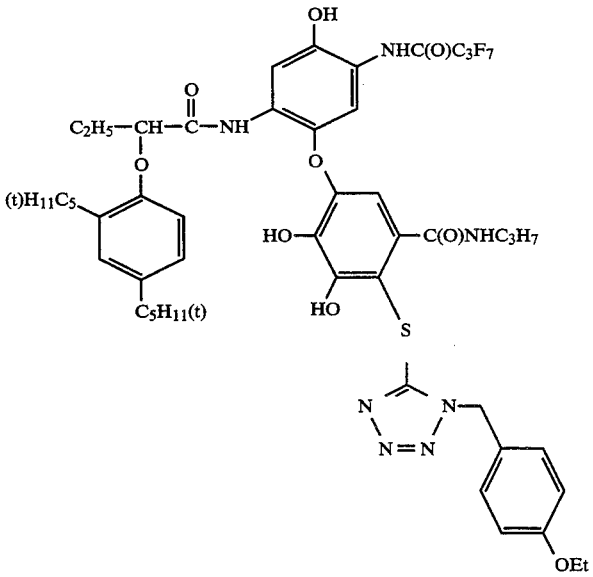

-continued
DIR-12
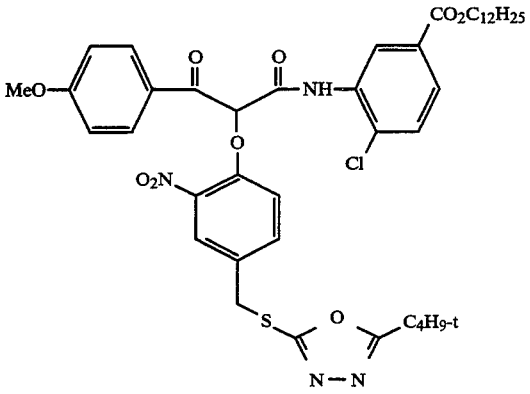
DIR-13
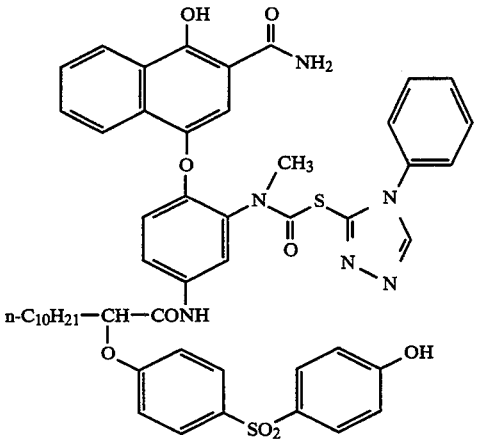
DIR-14
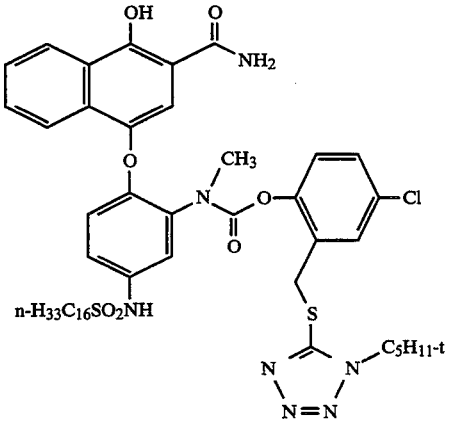
DIR-15
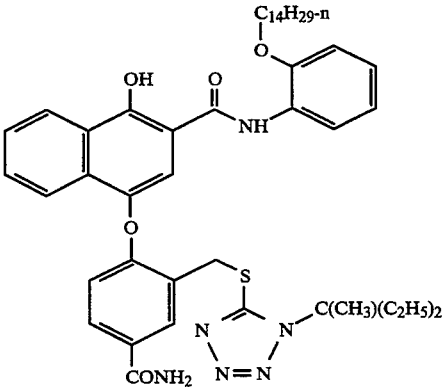
DIR-16
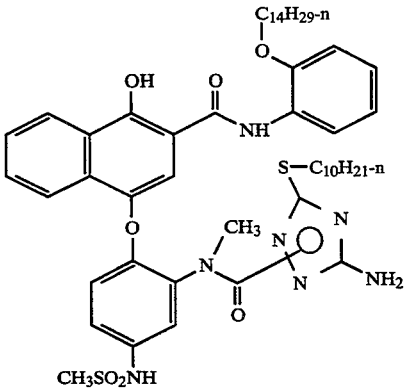
DIR-17
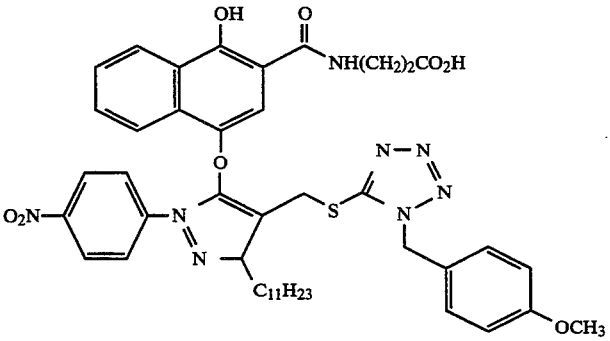

-continued
DIR-18
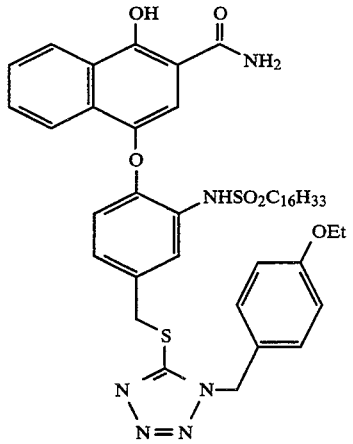
DIR-19
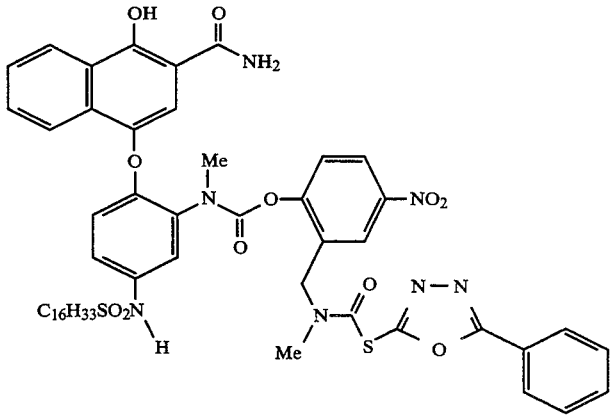
DIR-20
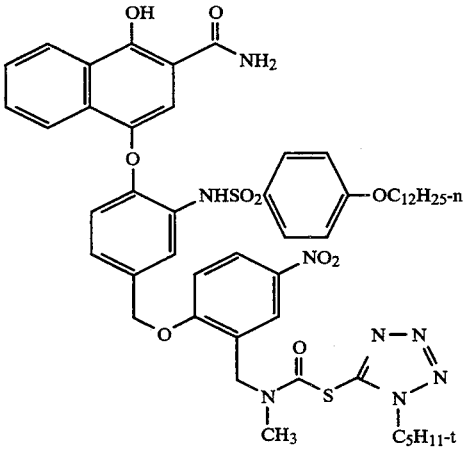
DIR-21
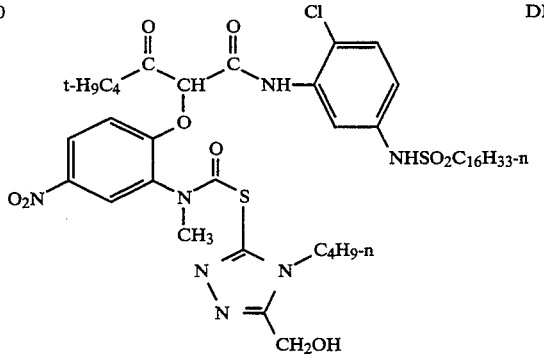
DIR-22
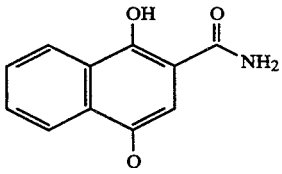

-continued
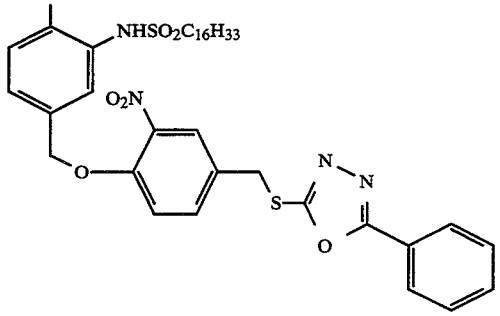
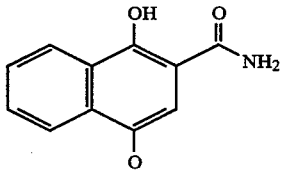
DIR-23
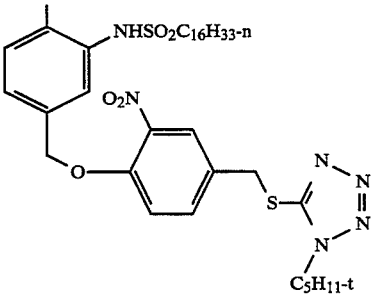
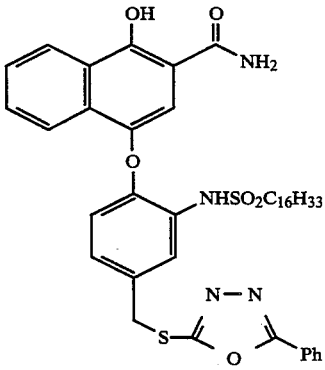
DIR-24
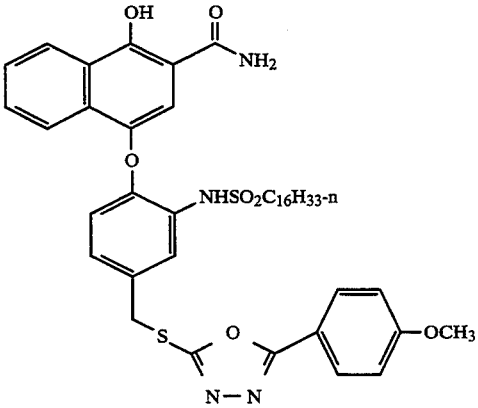
DIR-25
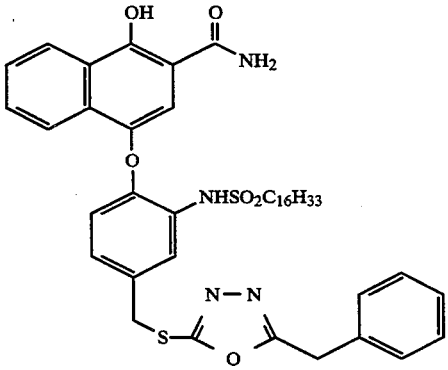
DIR-26
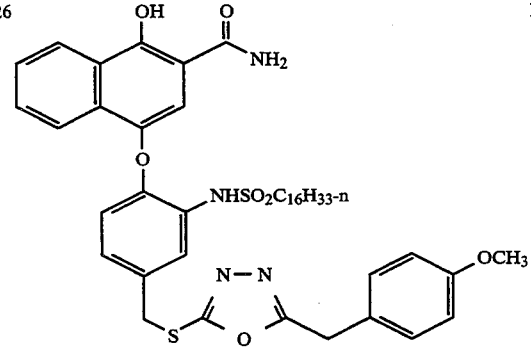
DIR-27

-continued
DIR-28
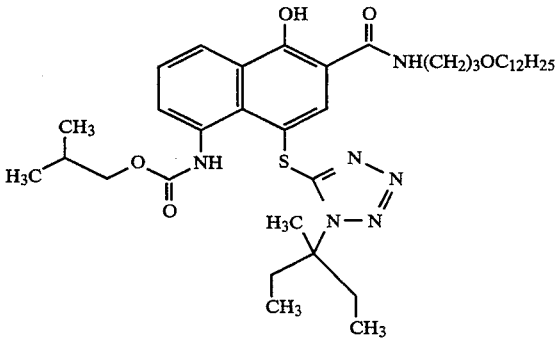
DIR-29
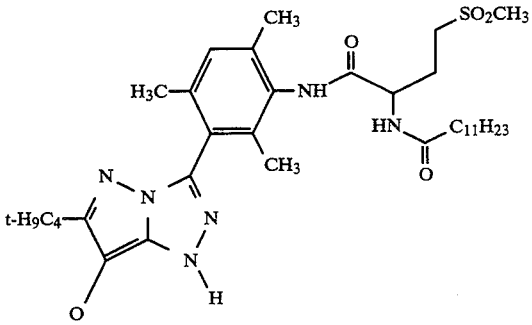
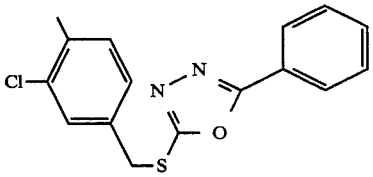
DIR-30
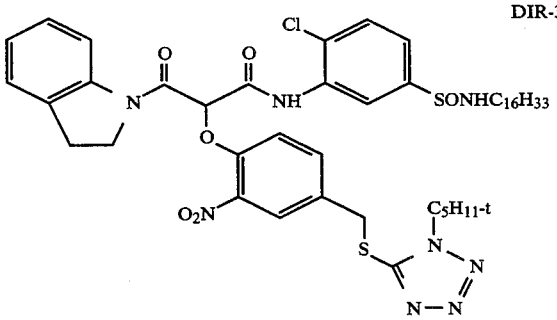
DIR-31
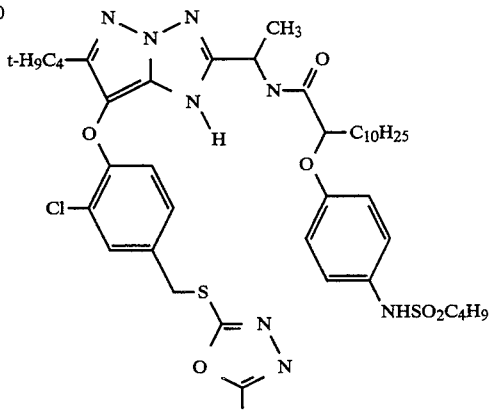
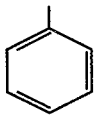

-continued
DIR-32
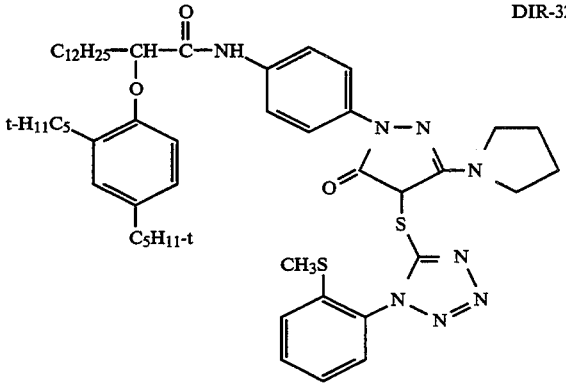
DIR-33
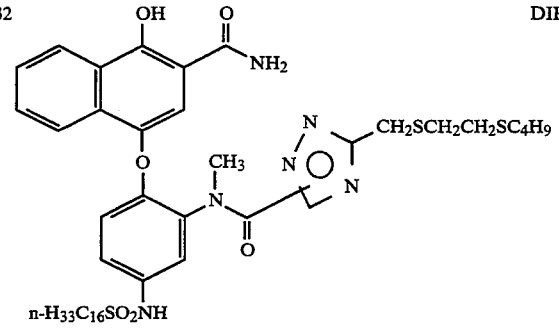
DIR-34
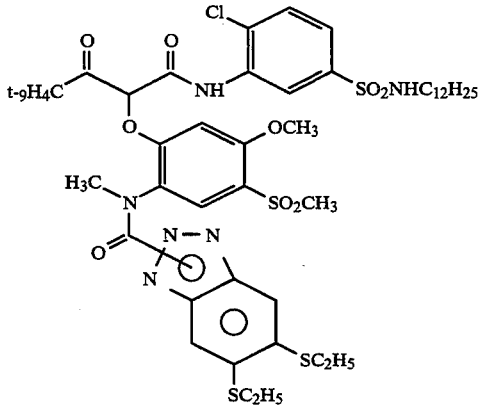
DIR-35
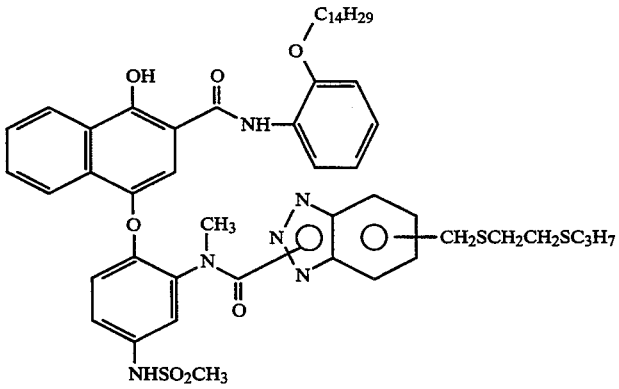
DIR-36
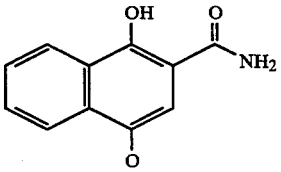

-continued

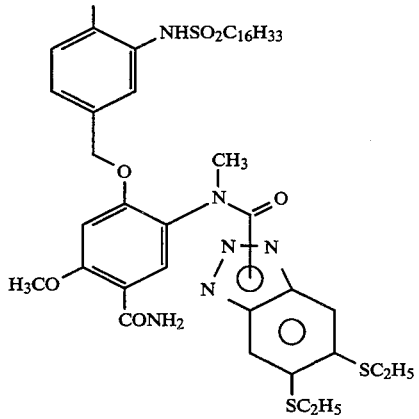

DIR-37

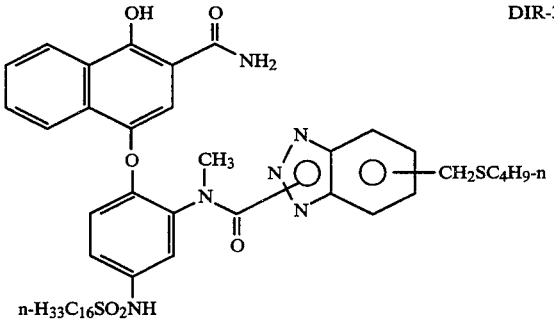

DIR-38

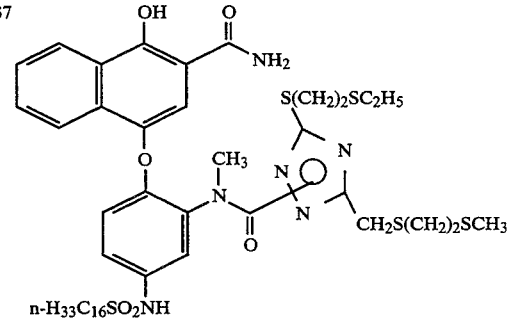

DIR-39

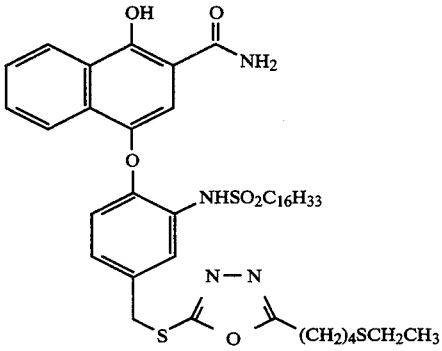

DIR-40

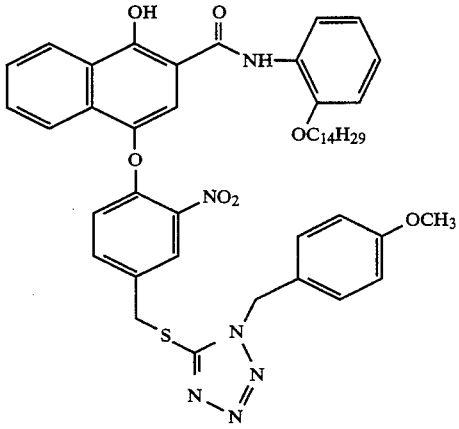

DIR-41

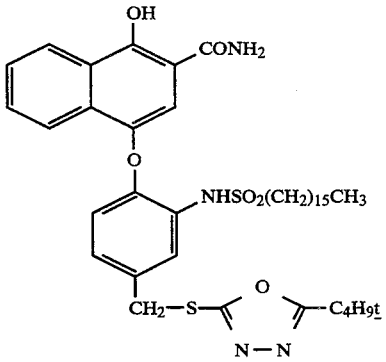

In order to incorporate the compounds according to the present invention and couplers to be used together into a silver halide emulsion layer known methods, including those described, e.g., in U.S. Pat. No. 2,322,027 can be used. For example, they can be dissolved in a solvent and then dispersed in a hydrophilic colloid. Examples of solvents usable for this process include organic solvents having a high boiling point, such as alkyl esters of phthalic acid (e.g., dibutyl phthalate, dioctyl phthalate, etc.), phosphoric acid esters (e.g., diphenyl phosphate, triphenyl phosphate, tricresyl phosphate, dioctyl butyl phosphate, etc.) citric acid esters (e.g., tributyl acetyl citrate, etc.) benzoic acid esters (e.g., octyl benzoate, etc.), alkylamides (e.g., diethyl laurylamides, etc.), esters of fatty acids dibutoxyethyl succinate, dioctyl azelate, etc.), trimesic acid esters (e.g., tributyl trimesate, etc.), or the like; and organic solvents having a boiling point of from about 30° to about 150° C., such as lower alkyl acetates (e.g., ethyl acetate, butyl acetate, etc.), ethyl propionate, secondary butyl alcohol, methyl isobutyl ketone, b-ethoxyethyl acetate, methyl cellosolve acetate, or the like. Mixtures of organic solvents having a high boiling point and organic solvents having a low boiling point can also be used.

It is also possible to utilize the dispersing method using polymers, as described in Japanese Patent Publication No. 39853/76 and Japanese Patent Application (OPI) No. 59943/76.

Of the couplers, those having an acid group, such as a carboxylic acid group or a sulfonic acid group, can be introduced into hydrophilic colloids as an aqueous alkaline solution.

As the binder or the protective colloid for the photographic emulsion layers or intermediate layers of the photographic light-sensitive material of the present invention, gelatin is advantageously used, but other hydrophilic colloids can be used alone or together with gelatin.

As gelatin in the present invention, not only lime-processed gelatin, but also acid-processed gelatin may be employed. The methods for preparation of gelatin are described in greater detail in Ather Veis, *The Macromolecular Chemistry of Gelatin*, Academic Press (1964).

As the above-describedhydrophilic colloids other than gelatin, it is possible to use proteins such as gelatin derivatives, graft polymers of gelatin and other polymers, albumin, casein, etc.; saccharides such as cellulose derivatives such as hydroxyethyl cellulose, cellulose sulfate, etc., sodium alginate, starch derivatives, etc.; and various synthetic hydrophilic high molecular weight substances such as homopolymers or copolymers, for example, polyvinyl alcohol, polyvinyl alcohol semiacetal, poly-N-vinylpyrrolidone, polyacrylic acid, polymethacrylic acid, polyacrylamide, polyvinyl imidazole, polyvinylpyrazole, etc.

In the photographic emulsion layer of the photographic light-sensitive material used in the present invention, any of silver bromide, silver iodobromide, silver iodochlorobromide, silver chlorobromide and silver chloride may be used as the silver halide. A preferred silver halide is silver iodobromide Containing 15 mol % or less of silver iodide. A silver iodobromide emulsion containing from 2 mol % to 12 mol % of silver iodide is particularly preferred.

Although the mean grain size of silver halide particles in the photographic emulsion (the mean grain size being determined with a grain diameter in those particles which are spherical or nearly spherical, and an edge length in those particles which are cubic as a grain size, and is expressed as a mean value calculated from projected areas) is not particularly limited, it is preferably 6 μm or less.

The distribution of grain size may be broad or narrow.

Silver halide particles in the photographic emulsion may have a regular crystal structure, e.g., a cubic or octahedral structure, an irregular crystal structure, e.g., a spherical or plate-like structure, or a composite structure thereof. In addition, silver halide particles composed of those having different crystal structures may be used.

Further, the photographic emulsion wherein at least 50 percent of the total projected area of silver halide particles in tabular silver halide particles having a diameter at least five times their thickness may be employed.

The inner portion and the surface layer of silver halide particles may be different in phase. Silver halide particles may be those in which a latent image is formed mainly on the surface thereof, or those in which a latent image is formed mainly in the interior thereof.

The photographic emulsion used in the present invention can be prepared in any suitable manner, e.g., by the methods as described in P. Glafkides, *Chimie et Physique Photographique*, Paul Montel (1967), G. F. *Duffin, Photographic Emulsion Chemistry*, The Focal Press (1966), and V. L. Zelikman et al., *Making and Coating Photographic Emulsion*, The Focal Press (1964). That is, any of an acid process, a neutral process, an ammonia process, etc., can be employed.

Soluble silver salts and soluble halogen salts can be reacted by techniques such as a single jet process, a double-jet process, and a combination thereof. In addition, there can be employed a method (so-called reversal mixing process) in which silver halide particles are formed in the presence of an excess of silver ions.

As one system of the double jet process, a so-called controlled double jet process in which the pAg in a liquid phase where silver halide is formed is maintained at a predetermined level can be employed. This process can produce a silver halide emulsion in which the crystal form is regular and the grain size is nearly uniform.

Two or more kinds of silver halide emulsions which are prepared separately may be used as a mixture.

The formation or physical ripening of silver halide particles may be carried out in the presence of cadmium salts, zinc salts, lead salts, thallium salts, iridium salts or its complex salts, the rhodium salts or its complex salts, iron salts or its complex salts, and the like.

For removal of soluble salts from the emulsion after precipitate formation or physical ripening, a well known noodle washing process in which gelatin is gelated may be used. In addition, a flocculation process utilizing inorganic salts having a polyvalent anion (e.g., sodium sulfate), anionic surface active agents, anionic polymers (e.g., polystyrenesulfonic acid), or gelatin derivatives (e.g., aliphatic acylated gelatin, aromatic acrylated gelatin and aromatic carbamoylated gelatin) may be used.

Silver halide emulsions are usually chemically sensitized. For this chemical sensitization, for example, the methods as described in H. Frieser ed., *Die Grundlagen Der Photographischen Prozesse mir Silberhalogeniden, Akademische* Verlagsgesellschaft, pages 675 to 734 (1968) can be used. Namely, a sulfur sensitization process using active gelatin or compounds (e.g., thiosulfates, thioureas, mercapto compounds and rhodanines) containing sulfur capable of reacting with silver; a reduction sensitization process using reducing substances (e.g., stannous salts, amines, hydrazine derivatives, formamidinesulfinic acid and silane compounds); a noble metal sensitization process using noble metal compounds (e.g., complex salts of Group VIII metals in the Periodic Table, such as Pt, Ir and Pd, etc., as well as gold complex salts); and so forth can be applied alone or in combination with each other.

The photographic emulsion used in the present invention may include various compounds for the purpose of preventing fog formation or of stabilizing photographic performance in the photographic light sensitive material during the production, storage or photographic processing thereof. For example, those compounds known as antifoggants or stabilizers can be incorporated, including azoles such as benzothiazolium salts; nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particular 1-phenyl-5-mercaptotetrazole), etc.; mercaptopyrimidines; mercaptotriazines; thioketo compounds such as oxazolinethione, etc.; azaindenes such as triazaindenes, tetraazaindenes (particularly 4-hydroxysubstituted(1,3-,3a,7)tetraazaindenes), pentaazaindenes, etc.; benzenethiosulfonic acids; benzenesulfinic acids; benzenesulfonic amides, etc.

In the photographic emulsion layers or other hydrophilic colloid layers of the photographic lightsensitive material of the present invention can be incorporated various surface active agents as coating aids or for other various purposes, e.g., prevention of charging, improvement of slipping properties, acceleration of emulsification and dispersion, prevention of adhesion and improvement of photographic characteristics (for example, development acceleration, high contrast, and sensitization), etc.

Surface active agents which can be used are nonionic surface active agents, e.g., saponin (steroid-based), alkyene oxide derivatives (e.g., polyethylene glycol, a polyethylene glycol/polypropylene glycol condensate, polyethylene glycol alkyl ethers or polyethylene glycol alkylaryl ethers, polyethylene glycol esters, polyethylene glycol sorbitan esters, polyalkylene glycol alkylamines or polyalkylene glycol alkylamides, and silicone/polyethylene oxide adducts, etc.), glycidol derivatives (e.g., alkenylsuccinic acid polyglyceride and alkylphenol polyglyceride, etc.), fatty acid esters of polyhydric alcohols and alkyl esters of sugar, etc.; anionic surface active agents containing an acidic group, such as a carboxy group, a sulfo group, a phospho group, a sulfuric acid esters group, and a phosphoric acid ester group, for example, alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkylpolyoxyethylene alkylphenyl ethers, and polyoxyethylene alkylphosphoric acid esters, amphoteric surface active agents, such as amino acids, aminoalkylsulfonic acids, aminoalkylsulfuric acid or aminoalkylphosphoric acid esters, alkylbetaines, and amine oxides; and cationic surface active agents, e.g., alkylamine salts, aliphatic or aromatic quaternary ammonium salts, heterocyclic quaternary ammonium salts (e.g., pyridiniumand imidazolium) and aliphatic or hetercyclic phosphonium or sulfonium salts.

The photographic emulsion layer of the photographic light-sensitive material of the present invention may contain compounds such as polyalkylene oxide or its ether, ester, amine or like derivatives, thioether compounds, thiomorpholines, quaternary ammonium salt compounds, urethane derivatives, urea derivatives, imidazole derivatives, and 3-pyrazolidones for the purpose of increasing sensitivity or contrast, or of accelerating development.

In the photographic emulsion layer or other hydrophilic colloid layers of the photographic lightsensitive material of the present invention can be incorporated water-insoluble or sparingly soluble synthetic polymer dispersions for the purpose of improving dimensional stability, etc. Synthetic polymers which can be used include homo- or copolymers of alkyl acrylate or methacrylate, alkoxyalkyl acrylate or methacrylate, glycidyl acrylate or methacrylate, acrylamide or methacrylamide, vinyl esters (e.g., vinyl acetate), acrylonitrile, olefins, styrene, etc. and copolymers of the foregoing monomers and acrylic acid, methacrylic acid, $\alpha,\beta$-unsaturated dicarboxylic acid, hydroxyalkyl acrylate or methacrylate, sulfoalkyl acrylate or methacrylate, and styrenesulfonic acid, etc.

In photographic processing of layers composed of photographic emulsions in the photographic light sensitive material of the present invention, any of known procedures and known processing solutions, those described in *Research Disclosure*, No. 176, pages 28 to 30 can be used. The processing temperature is usually chosen from between 18° C. and 50° C., although it may be lower than 18° C. or higher than 50° C.

Any fixing solutions which have compositions generally used can be used in the present invention. As fixing agents, thiosulfuric acid salts and thiocyanic acid salts, and in addition, organic sulfur compounds which are known to be effective as fixing agents can be used. These fixing solutions may contain water-soluble aluminum salts as hardeners.

Color developing solutions are usually alkaline aqueous solutions containing color developing agents. As these color developing agents, known primary aromatic amine developing agents, e.g., phenylenediamines such as 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-$\beta$-methanesulfonamidoethylaniline, 4-amino-3-methyl-N-ethyl-N-$\beta$-methoxyethylaniline, etc., can be used to make exhaustive color reversal developers.

In addition, the compounds as described in L. F. A. Mason, *Photographic Processing Chemistry*, Focal Press, pages 226 to 229 (1966), U.S. Pat. Nos. 2,193,015 and 2,592,364, Japanese Patent Application (OPI) No. 64933/73, etc., may be used.

The color developing solutions can further contain pH buffering agents such as sulfite, carbonates, borates and phosphates of alkali metals, etc. developing inhibitors or anti-fogging agents such as bromides, iodides or organic anti-fogging agents, etc. In addition, if desired, the color developing solution can also contain water softeners; preservatives such as hydroxylamine, etc.; organic solvents such as benzyl alcohol, diethylene glycol, etc.; developing accelerators such as polyethylene glycol, quaternary ammonium salts, amines, etc; dye forming couplers; competing couplers; fogging agents such a sodium borohydride, etc.; auxiliary developing agents; viscosity-imparting agents; acid type chelating agents; anti-oxidizing agents; and the like.

After color developing, the photographic emulsion layer is usually bleached. This bleach processing may be performed simultaneously with a fix processing, or they may be performed independently.

Bleaching agents which can be used include compounds of metals, e.g., iron (III), cobalt (III), chromium (VI), and copper (II) compounds. For example, organic complex salts of iron (III) or cobalt (III), e.g., complex salts of acids (e.g., nitrilotriacetic acid, 1,3-diamino-2-propanoltetraacetic acid, etc.) or organic acids (e.g., citric acid, tartaric acid, malic acid, etc.); persulfates; permanganates; nitrosophenol, etc. can be used. Of these compounds, potassium ferricyanide, iron (III) sodium ethylenediaminetetraacetate, and iron (III) ammonium ethylenediaminetetraacetate are particularly useful. Ethylenediaminetetraacetic acid iron (III) complex salts are useful in both an independent bleaching solution and a mono-bath bleachfixing solution.

The photographic emulsion used in the present invention can also be spectrally sensitized with methine dyes or other dyes. Suitable dyes which can be employed include cyanine dyes, merocyanine dyes, complex cyanine dyes, complex merocyanine dyes, homopolar cyanine dyes, hemicyanine dyes, styryl dyes, and hemioxonol dyes. Of these dyes, cyanine dyes, merocyanine dyes and complex merocyanine dyes are particularly useful.

Any conventionally utilized nuclei for cyanine dyes are applicable to these dyes as basic heterocyclic nuclei. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei can also be substituted.

The merocyanine dyes and the complex merocyanine dyes that can be employed contain 5- or 6-membered heterocyclic nuclei such as pyrazolin-5-one nucleus, a thiohydantoin nucleus, a 2-thioxazolidin-2,4-dione nucleus, a thiazolidine-2,4-dione nucleus, a rhodanine nucleus, a thiobarbituric acid nucleus, and the like.

These sensitizing dyes can be employed individually, and can also be employed in combination. A combination of sensitizing dyes is often used particularly for the purpose of supersensitization.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No, 3,743,510), cadmium salts, azaindene compounds, and the like, can be present.

The present invention is also applicable to a multilayer multicolor photographic material containing layers sensitive to at least two different spectral wavelength ranges on a support. A multilayer color photographic material generally possesses at least one red-sensitive silver halide emulsion layer, at least one green-sensitive silver halide emulsion layer and at least one blue-sensitive silver halide emulsion layer, respectively, on a support. The order of these layers can be varied, if desired. Ordinarily, a cyan forming coupler is present in a red-sensitive emulsion layer, a magenta forming coupler is present in a green-sensitive emulsion layer and yellow forming coupler is present in a blue-sensitive emulsion layer, respectively. However, if desired, a different combination can be employed.

The color reversal films of this invention are typically multilayer materials such as described in U.S. Pat. Nos. 4,082,553, 4,729,943, and 4,912,024; paragraph bridging pages 37–38. The support and other elements are as known in the art, e.g. see U.S. Pat. No. 4,912,024, column 38, line 37, and references cited therein.

EXAMPLE 1

The invention is illustrated by the following example:

A method for the determination of "inhibitor strength" is described below:

First, a green sensitive silver bromoiodide gelatin emulsion containing 4.0 mol-percent iodide and having an approximate grain length/thickness ratio of 0.70/0.09 micrometers was mixed with a coupler dispersion comprising Cyan Coupler C-1 dispersed in half its weight of di-n-butylphthalate. The resulting mixture was coated onto a cellulose triacetate support according to the following format:

| | | |
|---|---|---|
| OVERCOAT LAYER: | gelatin | 7.5 g/m2 |
| | bis(vinylsulfonylmethyl)ether hardener (1.9% of total gelatin weight) | |
| EMULSION LAYER: | AgBrI emulsion | 1.08 g/m2 (as silver) |
| | coupler | 2.07 mmoles/m2 |
| | gelatin | 4.04 g/m2 |
| FILM SUPPORT | | |

The resulting photographic element (hereafter referred to as the test coating) was cut into 12 inch×35 mm strips and was imagewise exposed to light through a graduated density test object in a commercial sensitometer (3000 K light source, 0–3 step wedge, with a Wratten 99 plus 0.3 ND filter) for 0.01 sec to provide a developable latent image. The exposed strip as then slit lengthwise into two 12 inch x 16 mm strips. One strip so prepared was subjected to the photographic process sequence outlined below:

| | |
|---|---|
| First developer | 4 min. |
| Water wash | 2 min. |
| Reversal bath | 2 min. |
| Color developer | 4 min. |
| Conditioner | 2 min. |
| Bleach | 6 min. |
| Fix | 4 min. |
| Water wash | 2 min. |

All solutions of the above process were held at a temperature of 36.9 ° C. The compositions of the processing solution are as follows:

| First developer: | |
|---|---|
| Amino tris(methylenephosphonic acid), pentasodium salt | 0.56 g |
| Diethylenetriaminepentaacetic acid, pentasodium salt | 2.50 g |
| Potassium sulfite | 29.75 g |
| Sodium bromide | 2.34 g |
| Potassium hydroxide | 4.28 g |
| Potassium iodide | 4.50 mg |

-continued

| | |
|---|---|
| 4-Hydroxymethyl-4-methyl-1-phenyl-3-pyrazolidinone | 1.50 g |
| Potassium carbonate | 14.00 g |
| Sodium bicarbonate | 12.00 g |
| Potassium hydroquinone sulfonate | 23.40 g |
| Acetic acid (glacial) | 0.58 g |
| Water to make | 1.0 liter |
| Reversal bath: | |
| Propionic acid | 11.90 g |
| Stannous chloride (anhydrous) | 1.65 g |
| p-Aminophenol | 0.5 mg |
| Sodium hydroxide | 4.96 g |
| Amino tris(methylenephosphonic acid), | 8.44 g |
| Water to make | 1.0 liter |
| Color Developer: | |
| Amino tris(methylenephosphonic acid), pentasodium salt | 2.67 g |
| Phosphoric acid (75% solution) | 17.40 g |
| Sodium bromide | 0.65 g |
| Potassium iodide | 37.5 mg |
| Potassium hydroxide | 27.72 g |
| Sodium sulfite | 6.08 g |
| Sodium metabisulfite | 0.50 g |
| Citrazinic acid | 0.57 g |
| Methanesulfonamide, N-[2-[(4-amino-3-methylphenyl)ethylamino]ethyl]-sulfate (2:3) | 10.42 g |
| 3,6-dithia-1,8-octanediol | 0.87 g |
| Acetic acid (glacial) | 1.16 g |
| Water to make | 1.0 liter |
| Conditioner: | |
| (Ethylenedinitrillo)tetraacetic acid | 8.00 g |
| Potassium sulfite | 13.10 g |
| Thioglycerol | 0.52 g |
| Water to make | 1.0 liter |
| Bleach: | |
| Potassium nitrate | 25.00 g |
| Ammonium bromide | 64.20 g |
| Anmonium ferric (ethylenediamine) | 124.9 g |
| Hydrobromic acid | 24.58 g |
| (Ethylenedinitrilo)tetraacetic acid | 4.00 g |
| Potassium hydroxide | 1.74 g |
| Water to make | 1.0 liter |
| Fixer: | |
| Ammonium thiosulfate | 95.49 g |
| Ammonium sulfite | 6.76 g |
| (Ethylenedinitrilo)tetraacetic acid | 0.59 g |
| Sodium metabisulfite | 7.12 g |
| Sodium hydroxide | 1.00 g |
| Water to make | 1.0 liter |

After the test coating was subjected to this processing sequence and dried the maximum density was read to status A densitometry using a commercial densitometer. This density is called $D_{max}$ (solution A).

The other half of the exposed test coating was processed through the same sequence except that the color developer contained 0.25 mmol of the INH compound in addition to the components listed in the above formula. The maximum density obtained for the test coating processed in this manner is called $D_{max}$ (solution B). The inhibitor number, IN, of the INH compound is defined as:

$$IN = \frac{D_{max}\text{ (solution } A) - D_{max}\text{ (solution } B)}{Dmax\text{ (solution } A)} \times 100$$

The inhibitor strength, IS, of the INH compound is defined as:

$$IS = \frac{IN_{(test)}}{IN_{(control)}}$$

$$IS = \frac{IN_{(test)}}{IN_{(control)}}$$

where $IN_{(test)}$ is the inhibitor number determined by the method described above for any INH compound of interest, and IN(control) is the inhibitor number determined for the test coating when 1-phenyl-5-mercapto-1,2,3,4-tetrazole is the INH compound incorporated into the color developer.

It has been found that compounds having the structural formula $$CAR\text{-}(TIME)_n\text{-}INH$$

wherein INH comprises a compound that has a inhibitor strength greater than 1 provide particularly desirable results when incorporated into color reversal photographic elements.

The following examples further illustrate the use of strong DIRs as can be used in this invention:

EXAMPLE 1A 1.0 g of DIR-2 was dissolved in 2.0 g of N,N-Diethyl lauramide and 3.0 g of ethyl acetate with gentle heating. This solution was then brought to a temperature of 40 ° C. and then mixed with a solution containing 3.0 g pig gelatin and 0.3 g of the sodium salt of triisopropylnathphalene sulfonic acid dissolved in 40.7 g. of distilled water. The resulting mixture was then passed through a colloid mill three times to produce a dispersion. This dispersion was then used to prepare a photographic element designated as Sample 101 having the composition set forth below:

In the composition of the layers, the coating amounts are shown as g/m$^2$, except for sensitizing dyes, which are shown as the molar amount per mole of silver halide present in the same layer.

| Photographic support: cellulose triacetate subbed with gelatin. | |
|---|---|
| First layer: Red sensitive layer | |
| Silver iodobromide emulsion (as silver) (4 mol % iodide) | 1.18 |
| Red sensitizing dyes | $1.42 \times 10^{-3}$ |
| Cyan Coupler C-1 | 1.71 |
| Tritolylphosphate | 0.85 |
| DIR-2 | 0.04 |
| Gelatin | 4.03 |
| Second layer: Intermediate layer | |
| Competitor S-3 | 0.16 |
| Dye-1 | 0.06 |
| Gelatin | 0.86 |
| Third layer: Green sensitive layer | |
| Silver iodobromide emulsion (as silver) (4 mol % iodide) | 1.18 |
| Green sensitizing dyes | $2.0 \times 10^{-3}$ |
| Coupler M-1 | 1.67 |
| Tritolylphosphate | 0.84 |

-continued
| | |
|---|---|
| Gelatin | 4.03 |
| Fourth layer: Protective layer | |
| Gelatin | 3.23 |
| Bis(vinylsulfonylmethane) | 0.23 |
COM INH-1
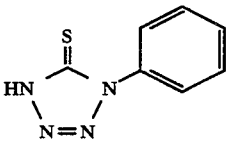
COM INH-2
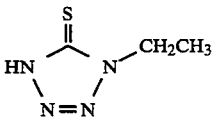
COM INH-3
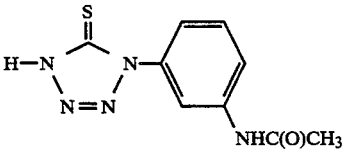
COM INH-4
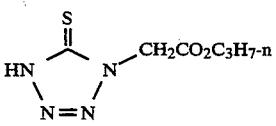
COM INH-5
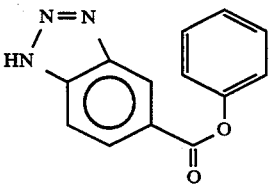
COM DIR-1
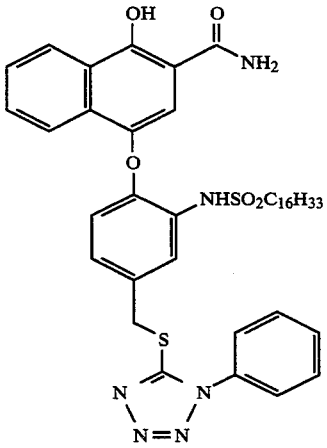
COM DIR-2
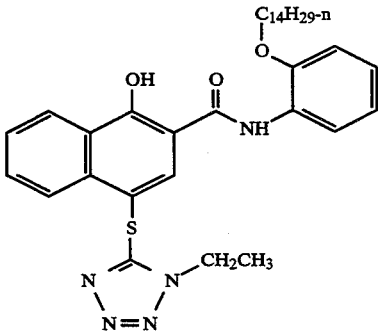
COM DIR-3
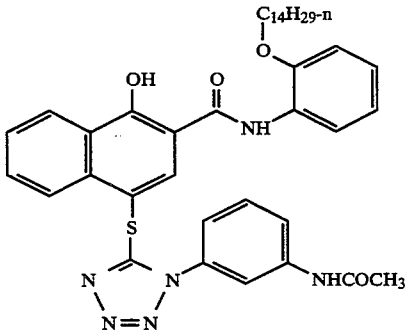
COM DIR-4
COM DIR-5

-continued
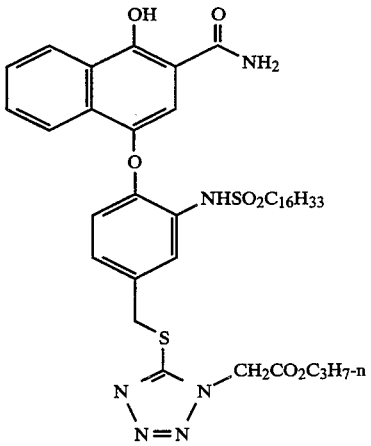
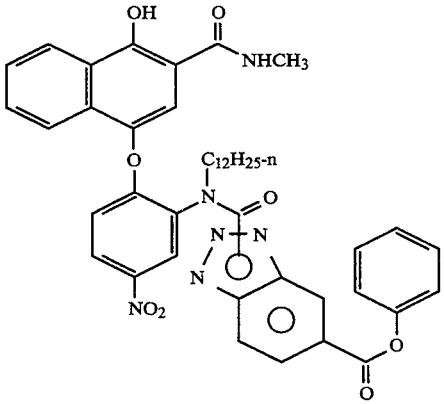
Antifoggant
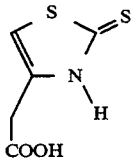
C-1
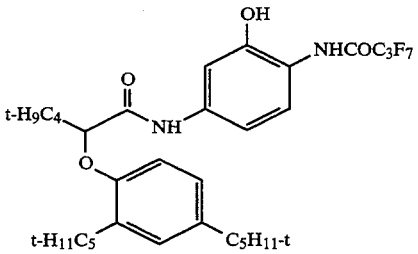
M-1
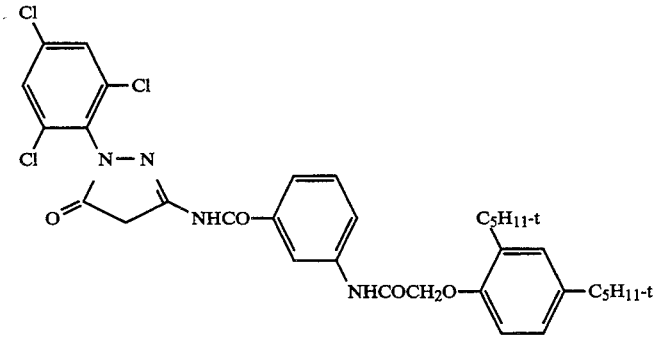
M-2
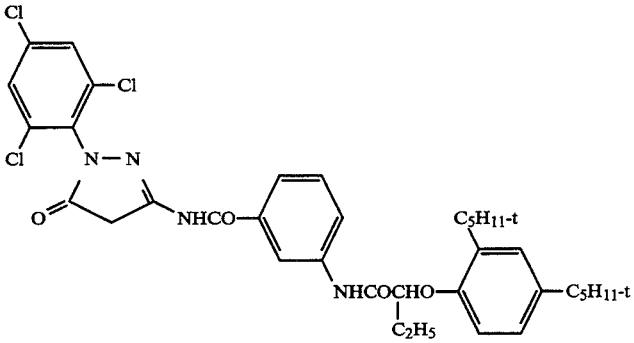
Y-1

-continued
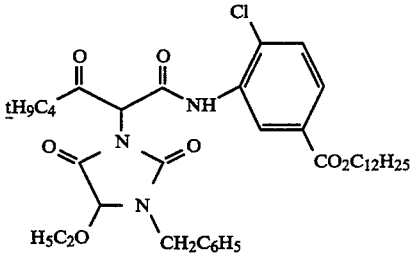
S1
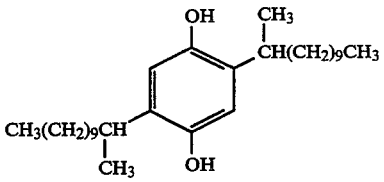
S-2
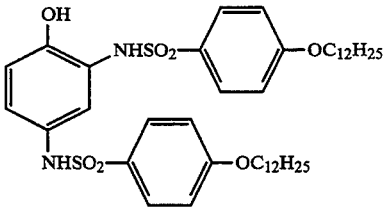
S-3
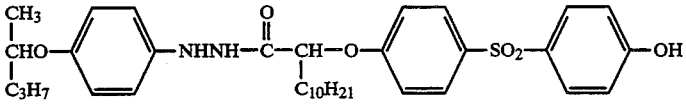
DYE-1
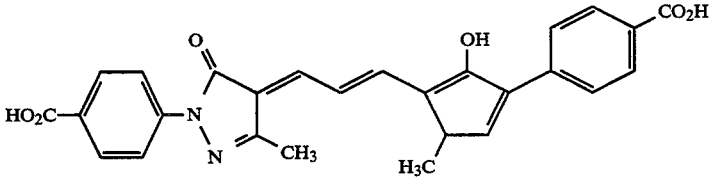
SENSITIZING DYE-1
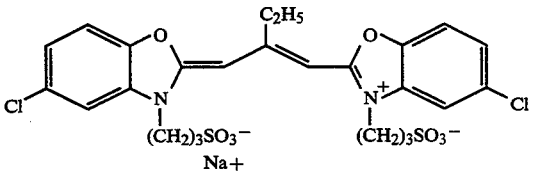
SENSITIZING DYE-2
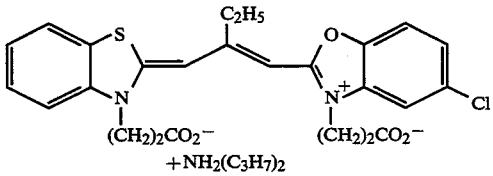
Cyan Absorber Dye
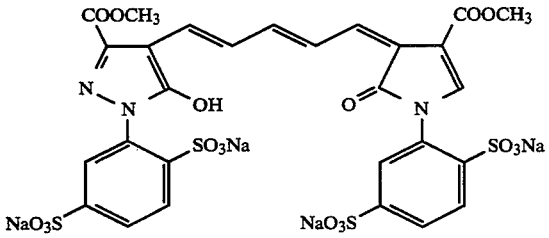
Magenta Absorber Dye
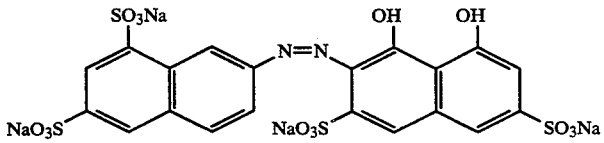
Yellow Absorber Dye -continued

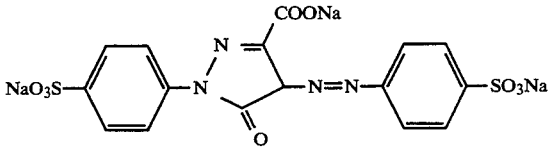

In a similar fashion samples 102 to 109 were prepared except that DIR-2 was replaced with equimolar amounts of the DIR as indicated in Table 1. After drying, the samples were slit into 12 inch×35 mm strips and exposed as follows:

First, the red-sensitive layer was exposed in an imagewise fashion to a 0–3 density step tablet plus a Wratten 29 filter using a commercial sensitometer (3000 k lamp temperature) for 0.01 sec. The green-sensitive layer was then given a uniform flash exposure using the same sensitometer with a Wratten 99 filter, but without the step tablet. The intensity of the green exposure was selected to be that which gave a Status A green analytical maximum density of approximately 2.0, after photographic processing, for sample 100, which was identical in composition to sample 101 except that it contained no DIR. The exposed samples were processed according to the sequence described above. All solutions of the above process were held at a temperature of 36.9° C. The compositions of the processing solution are the same as described above.

After processing, the densities of the samples were read to status A densitometry using a commercial densitometer. The densities were converted to analytical densities in the usual manner so that the red and green densities reflected the amount of cyan and magenta dyes formed in the respective layers. The results are tabulated in Table 2, and the inhibitor strengths of the INH moieties released from the DIR compounds during color development are shown in Table 1. It can be seen that the DIR compounds that release INH moieties having inhibitor strengths greater than 1.00 produce greater reductions in the red maximum density than do the comparison DIR compounds that release INH fragments having inhibitor strengths less than 1.00. The ability to reduce the density in the layer in which the DIR compound is coated is an indication of DIR compound's ability to produce sharpness improvements. Also recorded in Table 2 is a parameter called Delta $D_{max}$ ($\Delta D_{max}$), which is the difference in the green density measured in an area of the film strip where the red density is a maximum, minus the green density measured in an area where the red density is a minimum. As such, this parameter reflects the ability of a DIR compound coated in one layer to alter the dye formation in another layer. The data in Table 2 shows that DIR compounds which release INH moieties that have inhibitor strengths greater than 1, have a substantially greater effect on the dye density formed in the green sensitive layer than do comparison DIR compounds that release INH moieties having inhibitor strengths less than 1. This very desirable property enables the preparation of color reversal elements that have enriched color saturation.

TABLE 1

| Sample | INH | IS |
|---|---|---|
| 100 | none | — |
| 101 | INH-1 | 1.77 |
| 102 | INH-3 | 1.67 |

TABLE 1-continued

| Sample | INH | IS |
|---|---|---|
| 103 | INH-12 | 1.95 |
| 104 | INH-13 | 2.11 |
| 105 | COM INH-1 | 1.00 |
| 106 | COM INH-2 | 0.05 |
| 107 | COM INH-3 | 0.24 |
| 108 | COM INH-4 | 0.00 |
| 109 | COM INH-5 | 0.00 |

TABLE 2

| Sample | DIR | INH in DIR | Red $D_{max}$ | $\Delta D_{max}$ (Green) |
|---|---|---|---|---|
| 100 | none | — | 3.15 | 0.21 |
| 101 | DIR-1 | INH-1 | 2.76 | 0.46 |
| 102 | DIR-23 | INH-3 | 1.67 | 0.41 |
| 103 | DIR-25 | INH-12 | 2.23 | 0.40 |
| 104 | DIR-24 | INH-13 | 1.82 | 0.68 |
| 105 | COM DIR-1 | COM INH-1 | 3.12 | 0.40 |
| 106 | COM DIR-2 | COM INH-2 | 3.21 | 0.20 |
| 107 | COM DIR-3 | COM INH-3 | 3.19 | 0.22 |
| 108 | COM DIR-4 | COM INH-4 | 3.21 | 0.29 |
| 109 | COM DIR-5 | COM INH-5 | 3.20 | 0.30 |

It should be noted that although, as discussed above, various spectral sensitizing dyes can be used, the red sensitizing dye set of RDYE-1 and RDYE-2 in combination; the green sensitizing dye set of GDYE-1, GDYE-2 and GDYE-3 in combination; and the blue sensitizing dye BDYE-1, each identified below, are considered particularly useful in the present invention. The foregoing red dye set provides low stain, high speed, and good spectral sensitivity. The green dye set, in addition to providing low stain and high speed, provides good spectral sensitivity at longer wavelengths. The blue dye provides good speed with excellent antifogging properites.

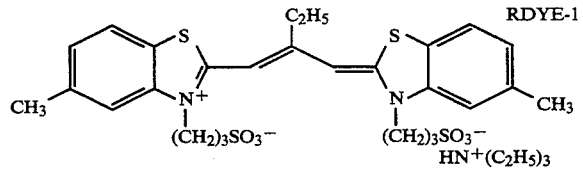

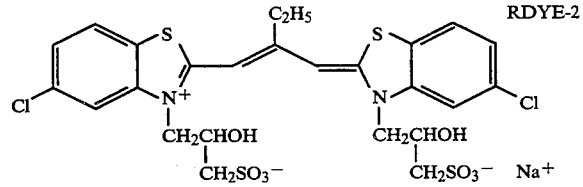

-continued

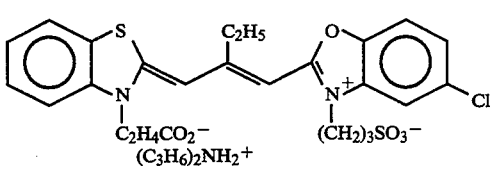

GDYE-1

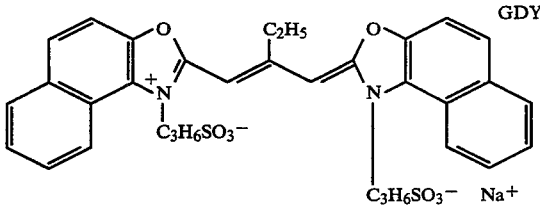

GDYE-2

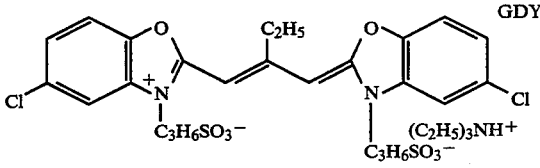

GDYE-3

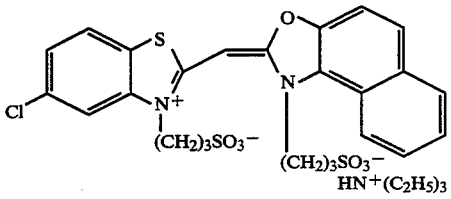

BDYE-1

The following examples further illustrate the present invention, and in particular illustrate the advantages of using both a DIR compound and fogged grains in reversal elements:

EXAMPLE 2

The following basic reversal film structure, 201, was used in all of the film structures of this Example. Other films listed in Tables 3 and 4 have a DIR compound and/or fogged grains added to the indicated layer of basic film structure 201. Film structure 201 was as follows (compound structures are provided later):

On a cellulose triacetate support provided with a subbing layer was coated each layer having the composition set forth below to prepare a multilayer color photographic light-sensitive material, which was designated as Film 201.

In the composition of the layers, the coating amounts are shown as g/m$^2$ except for sensitizing dyes, which are shown as the molar amount per mole of silver halide present in the same layer.

| | |
|---|---|
| First layer: Antihalation Layer | |
| Black Colloidal Silver | 0.43 (as silver) |
| Gelatin | 2.44 |
| Second layer: Intermediate Layer | |
| Gelatin | 1.22 |
| Third layer: Slow Red Sensitive Layer ("SR") | |
| Silver iodobromide emulsions (total) | 0.41 (as silver) |
| Red sensitizing dyes | $0.65 \times 10^{-3}$ |
| Cyan coupler CC-1 | 0.42 |
| Solvent-4 | 0.21 |
| Gelatin | 1.52 |
| Fourth Layer: Fast Red Sensitive Layer ("FR") | |
| Silver iodobromide emulsion | 0.83 (as silver) |
| Red sensitizing dyes | $0.35 \times 10^{-3}$ |
| Cyan coupler CC-1 | 0.89 |
| Solvent-4 | 0.45 |
| Gelatin | 1.44 |
| Fifth Layer: Intermediate Layer | |
| Competitor-1 | 0.145 |
| Gelatin | 0.61 |
| Antifoggant-1 | 0.00051 |
| Sixth Layer: Slow Green Sensitive Layer ("SG") | |
| Silver iodobromide emulsions (total) | 0.42 (as silver) |
| Green sensitizing dyes | $1.21 \times 10^{-3}$ |
| Coupler MC-2 | 0.14 |
| Coupler MC-1 | 0.32 |
| Solvent-3 | 0.18 |
| Gelatin | 2.21 |
| Seventh Layer: | |
| Fast Green Sensitive Layer ("FG") | |
| Silver iodobomide emulsion | 0.79 (as silver) |
| Green Sensitizing Dyes | $0.70 \times 10^{-3}$ |
| Coupler MC-2 | 0.23 |
| Coupler MC-1 | 0.53 |
| Solvent-3 | 0.39 |
| Gelatin | 1.73 |
| Eighth Layer: Intermediate Layer | |
| Blue absorbing dye for color balance | |
| Gelatin | 0.61 |
| Ninth Layer: Yellow Filter Layer | |
| Yellow Colloidal Silver | 0.07 (as silver) |
| Competitor-2 | 0.11 |
| Gelatin | 0.61 |
| Tenth Layer: Slow Blue Sensitive Layer ("SB") | |
| Silver iodobromide emulsions (total) | 0.57 (as silver) |
| Blue Sensitizing dye | $0.17 \times 10^{-3}$ |
| Coupler YC-1 | 0.73 |
| Solvent-4 | 0.24 |
| Gelatin | 1.35 |
| Eleventh Layer: | |
| Fast Blue Sensitive Layer ("FB") | |
| Silver iodobromide emulsion | 1.07 (as silver) |
| Blue sensitizing dye | $0.30 \times 10^{-3}$ |
| Coupler YC-1 | 1.60 |
| Solvent-4 | 0.53 |
| Gelatin | 2.69 |
| Twelfth Layer: First Protective Layer | |
| Ultraviolet Absorbing Dyes | 0.51 |
| Gelatin | 1.40 |
| Thirteenth Layer: Second Protective Layer | |
| Fine grain silver bromide emulsion | 0.12 (as silver) |
| Matte | 0.02 |
| Bis(vinylsulfonylmethane) | 0.29 |
| Gelatin | 0.97 |
| Solvent-3 = tritolyl phosphates | |
| Solvent-4 = dibutylphthalate | |

The equivalent circular diameter ("ECD") and iodide content of emulsions used are listed below. Note that layers 3, 6 and 10 used a combination of coarser and finer grain emulsions. The emulsions were all polymorphic.

| Layer | Average ECD (μm) | Iodide % |
|---|---|---|
| 11 | .98 | 2 |
| 10 | .50 | 3.4 |
| 10 | .33 | 3.4 |
| 7 | .60 | 2 |
| 6 | .25 | 4.8 |
| 6 | .16 | 4.8 |
| 4 | .65 | 3.4 |
| 3 | .25 | 4.8 |
| 3 | .16 | 4.8 |

Formulae for the DIR compounds additionally used as described below, and for the other compounds in the above are listed below.

COMPETITOR 1
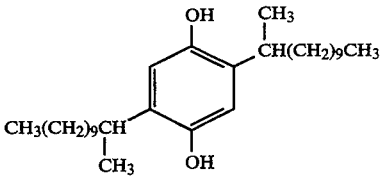
Competitor 2
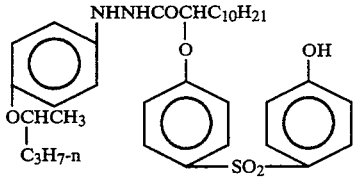
Antifoggant 1
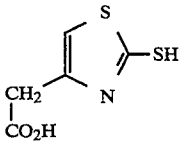
Coupler MC-1
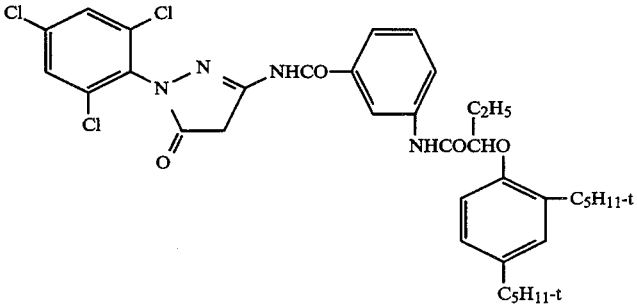
Coupler MC-2
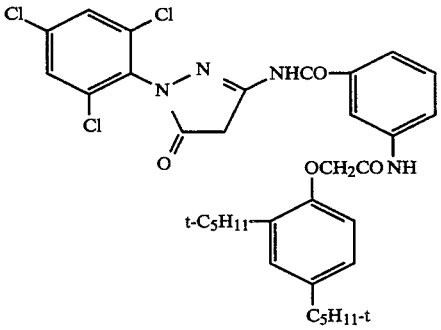
Coupler YC-1
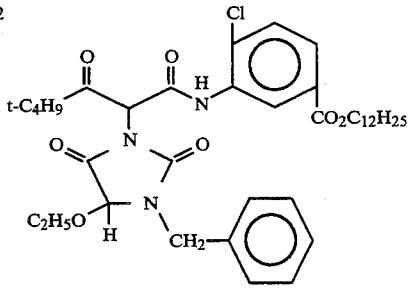
Coupler CC-1
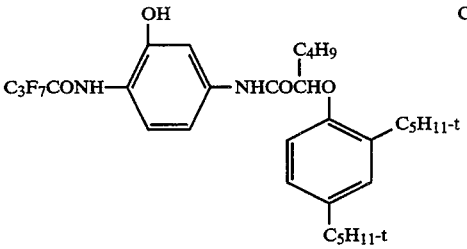
DIR-A
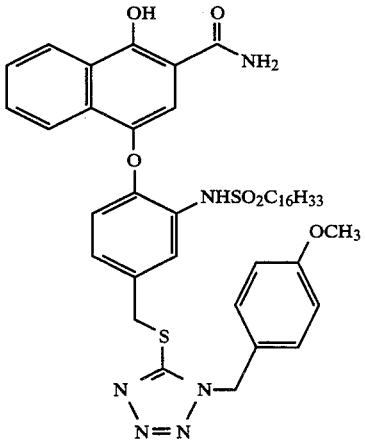

-continued

DIR-B

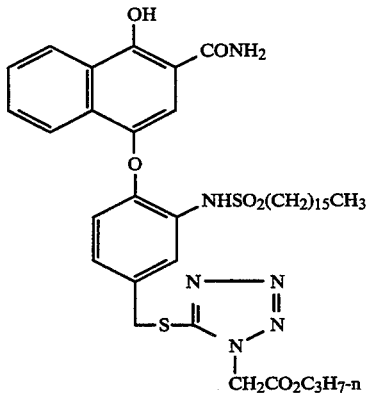

DIR-C

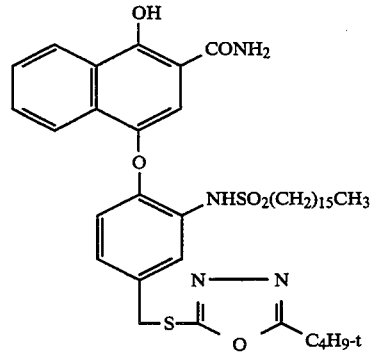

Additional films 202 through 211 were constructed the same as film 201, but with a DIR coupler (each of which released a strong inhibitor as defined above) in the fast red ("FR") layer or fast red and slow red ("FR and SR") layers and/or fogged grains in the slow green ("SG") layer, as indicated in Table 3 below. Structures for the DIR couplers used are above. The quantity of fogged grains added is shown as a percentage (based on moles of silver in fogged grains to total moles of imaging silver in the same layer). The fogged grains were provided in the form of a fine grain (0.15 μm diameter) silver bromoiodide (4.8% iodide) emulsion ripened with ammonia, chemically sensitized in the normal way and spectrally sensitized to green light. The chemically sensitized emulsion was fogged by heating with high pH and low pAg. The red onto green ("ROG") interimage effect ("IIE") is quantified in terms of the change in density (ΔD) of the receiving record (magenta record) which has been exposed to a uniform green flash such that the green density is 1.0 or 2.0 in regions without causer record (red record) exposure, when the causer record changes from unexposed to fully exposed. The Ratio is ΔD measured at D=2 divided by ΔD at D=1. All films were processed through the standard E6 process with a 6 minute first development time. The films had the silver laydown levels adjusted in anticipation of the density reduction due to DIR's and due to fogged grains. Speed was measured at a density of 1.0. "Uniformity" was an estimate of the film's uniformity to typical variations in standard processing.

TABLE 3

Effects of Fogged Grains with Various DIR's on IIIE

| Film No. | Description |
|---|---|
| 201) | Basic reversal film structure |
| 202) | Film 201 + 4% fogged grain in SG |
| 203) | Film 201 + 32.3 mg/m$^2$ of DIR-A in FR |
| 204) | Film 201 + 32.3 mg/m$^2$ of DIR-A in FR + 4% fog in SG |
| 205) | Film 201 + 43.0 mg/m$^2$ of DIR-A in FR + 4% fog in SG |
| 206) | Film 201 + 64.6 mg/m$^2$ of DIR-A in FR and SR |
| 207) | Film 201 + 64.6 mg/m$^2$ of DIR-A in FR and SR + 4% fog in SG |
| 208) | Film 201 + 64.6 mg/m$^2$ of DIR-C in FR and SR |
| 209) | Film 201 + 64.6 mg/m$^2$ of DIR-C in FR and SR + 4% fog in SG |
| 210) | Film 201 + 107.6 mg/m$^2$ of DIR-B in FR and SR |
| 211) | Film 201 + 107.6 mg/m$^2$ of DIR-B in FR and SR + 4% fog in SG |

| Film | ROG-IIE | | Ratio D=2/ | Green Speed | Green | Green AgX (mg/ | Uni-form- |
|---|---|---|---|---|---|---|---|
| No. | D=1. | D=2. | D=1 | LogE | Dmax | ft2) | ity |
| 201 | 0.31 | 0.35 | 1.13 | 1.15 | 3.16 | 111.9 | A |
| 202 | 0.44 | 0.59 | 1.34 | 0.95 | 3.14 | 125.2 | A |
| 203 | 0.38 | 0.43 | 1.13 | 1.14 | 3.12 | 111.9 | A |
| 204 | 0.54 | 0.74 | 1.37 | 0.89 | 3.38 | 154.4 | A |
| 205 | 0.60 | 0.99 | 1.65 | 0.89 | 3.57 | 159.2 | — |
| 206 | 0.49 | 0.81 | 1.65 | 1.14 | 2.95 | 141.1 | U |
| 207 | 0.70 | 1.17 | 1.65 | 0.99 | 2.77 | 154.4 | U |
| 208 | 0.59 | 1.12 | 1.90 | 1.26 | 2.20 | 141.1 | — |
| 209 | 0.76 | 1.38 | 1.81 | 1.17 | 1.95 | 154.1 | — |
| 210 | 0.38 | 0.55 | 1.46 | 1.07 | 3.53 | 141.1 | — |
| 211 | 0.57 | 0.78 | 1.36 | 0.91 | 3.56 | 154.4 | — |

A = indicates acceptable uniformity
U = unacceptable uniformity

In Table 3, in all cases (except film 211 at D=2.0) the ROG IIE of the film containing fogged grains with a DIR is greater than predicted based on adding the contributions due to the DIR and to the fogged grains when applied separately. In particular, the effect of the 4% fogged grains alone (film 202 compared with 201) increased interimage by 0.13 and 0.24 at D=1 and D=2. The effect due to 32.3 mg/m$^2$ of DIR-A (film 203 compared with 201) increased interimage by 0.07 at D=1 and 0.08 at D=2. The combined effect of 4% fogged grains plus 32.3 mg/m$^2$ of DIR-A (film 204 compared with 20) increased interimage by 0.23 at D=1.0, and 0.39 at D=2.0. In film 211 at D=2.0, the predicted value based on the component effects is 0.79, whereas the observed value is 0.78. This difference is not statistically significant. Table 3 shows that to achieve a particular level of IIE, the effects of fogged grains and DIR's superadd, and hence it is possible to use lower levels of DIR's.

In the examples, films 204 and 206 have about the same degree of ROG IIE, yet film 206 made without fogged grains requires twice the level of DIR's. At this level of DIR, the resulting nonuniformity from standard processing would make this film less desirable. On the other hand, film 204 had quite acceptable uniformity.

When adding fogged grains to a layer, the density is dramatically reduced. This can be compensated by increasing the imaging silver laydown in the record containing the fogged grains. In all the examples shown, the density loss due to fogged grains is corrected using 7.5% additional laydown of imaging silver per percent of fogged grains added. With the maximum densities thus corrected, the speed at a density of 1.0 is reduced as the level of fogged grains increases. This is shown in Table 4. Film 212 shown in Table 4 was the same as Film 201 in Table 3, and Films 213–215 were constructed the same as Film 212 except with the indicated amounts of the same fogged grains as used in Table 3 films was added to the slow green ("SG") layer.

TABLE 4

Speed Loss at D=1.0 with Fogged Grains in SM

| Film No. | Description |
|---|---|
| 212) | Basic reveral film structure |
| 213) | Film 212 + 2.5% fogged grain in SG |
| 214) | Film 212 + 5.0% fogged grain in SG |
| 215) | Film 212 + 7.5% fogged grain in SG |

| Film | ROG-IIE | | Ratio D=1 | Green Spd | Green | Green AgX |
|---|---|---|---|---|---|---|
| No. | D=1. | D=2. | D=2/ | LogE | Dmax | (mg/ft2) |
| 212 | 0.26 | 0.34 | 1.30 | 1.03 | 3.40 | 111.9 |
| 213 | 0.40 | 0.51 | 1.27 | 0.92 | 3.25 | 120.2 |
| 214 | 0.45 | 0.62 | 1.38 | 0.79 | 3.38 | 128.4 |
| 215 | 0.51 | 0.65 | 1.27 | 0.64 | 3.53 | 136.7 |

Note that film 215 containing 7.5% fogged grains has less interimage than film 204 which combines 4% fogged grains and 32.3 mg/m$^2$ of DIR-A. However, the speed penalty from using 7.5% fogged grains (Film 215) is 0.39 logE, whereas the combination of 4% fogged grains with 32.3 mg/m$^2$ of DIR-A (Film 204) is 0.26 logE. Thus, it is better to use the present invention with a DIR and fogged grains, than simply using the fogged grains or DIR alone.

In addition to the above, Tables 3 and 4 show that the ratio of increases in the ROG IIE at densities of 1.0 and 2.0 using fogged grains alone is limited to the range of 1.1 to 1.4. Films 205 through 209 in Table 3 show that with DIR's it is possible to increase this ratio to the range of 1.65 to 1.9. Films 204 and 205 show how it is possible to vary this ratio by varying the level of DIR in this film.

As can be seen from the above, the advantages of using a combination of fogged grain and DIR's can include:

a. The IIE achieved from the combination is as large as or exceeds the contributions from the fogged grains and DIR's when applied separately.

b. Use of the combination of fogged grains and DIR's to meet an IIE aim results in more uniform pictures since lower levels of DIR's can be employed.

c. Use of the combination of fogged grains and DIR's to meet an IIE aim results in higher speeds of the receiver record since lower levels of fogged grains can be employed.

d. Use of the combination of fogged grains and DIR's allows independent modification of the amounts of IIE achieved in the high receiver density and low receiver density regions (as indicated by the ratios of ROG IIE at D=1 and D=2 previously discussed). This is useful in tuning reproduction characteristics of a film such as described in U.S. Patent Application "Color Photographic Reversal Element with Improved Color Reproduction", Attorney Docket No. 61940, by F. Ford et al. filed on the same date as the present application and incorporated herein by reference.

The invention has been described in detail with particular reference to preferred embodiments, but it will be understood that variations and modifications can be effected within the spirit and scope of the invention.

What is claimed is:

1. A method of processing a color reversal element, which element has:

a) at least a first and a second layer, the first layer containing latent image forming iodide containing silver halide grains and the second layer containing latent image forming silver halide grains; and b) an inhibitor releasing compound in the first layer or a non-imaging layer associated with the first and second layers, the inhibitor releasing compound having the structural formula $$CAR\text{-}(TIME)_n\text{-}INH$$

wherein:

CAR is a carrier moiety from which -(TIME)$_n$-INH is released during color development;

TIME is a timing group;

INH is comprised of a development inhibitor moiety which has an inhibitor potency greater than 1 and which is selected from the group consisting of oxazole, thiazole, diazole, oxadiazole, oxathiazole, triazole, thiatriazole, benzotriazole, tetrazole, benzimidazole, indazole, isoindazole, mercaptotriazole, mercaptotetrazole, selenotetrazole, mercaptothiazole, selenobenzothiazole, mercaptobenzoxazole, selenobenzoxazole, mercaptobenzimidazole, selenobenzimidazole, benzodiazole, mercaptooxadiazole, and benzisodiazole;

n is 0, 1 or 2;

wherein inhibitor potency, IS, of the INH compound is defined as:

$$IS = \frac{IN_{(test)}}{IN_{(control)}}$$

$$IS = \frac{IN_{(test)}}{IN_{(control)}}$$

where IN$_{(test)}$ is the inhibitor number of INH and IN$_{(control)}$ is the inhibitor number for 1-phenyl-5-mercapto-1,2,3,4-tetrazole; and c) surface fogged silver halide grains in the second layer;

the method comprising first treating the element with a black and white developer to develop exposed silver halide grains, then treating the element with a color developer.

2. A method in accordance with claim 1 wherein INH has a structure selected from

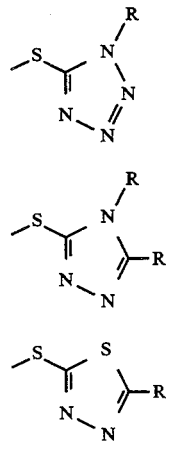

-continued

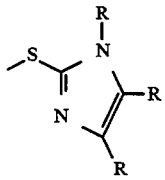

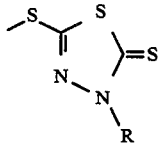

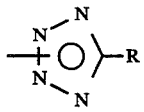

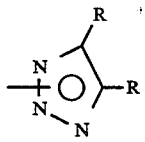

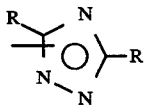

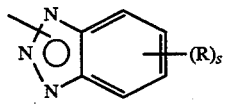

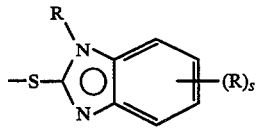

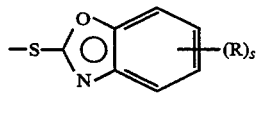

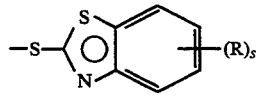

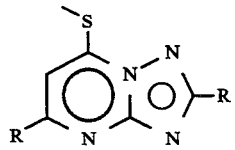

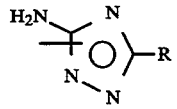

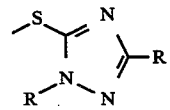

-continued

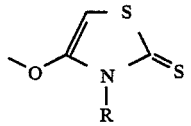

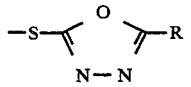

wherein R is a substituted or unsubstituted alkyl group, hydrogen, halogen, a substituted or unsubstituted aryl group, a 5- or 6-membered heterocyclic ring, alkoxy group, aryloxy group, alkoxycarbonyl group, aryloxycarbonyl group, amino group, sulfamoyl group, sulfonamido group, sulfoxyl group carbamoyl group, alkylsulfo group, arylsulfo group, hydroxy group, aryloxycarbonylamino group, alkoxycarbonylamino group, acylamino group, ureido group, arylthio group, alkylthio group, cyano group, and s is 1 to 4.

3. A method in accordance with claim 1 wherein INH selected from:

INH-1

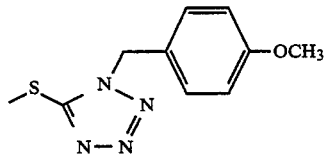

INH-2

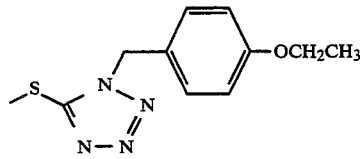

INH-3

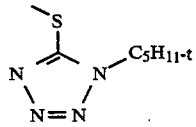

INH-4

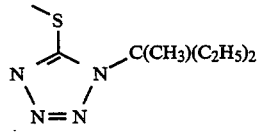

INH-5

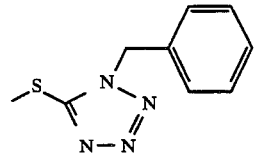

INH-6

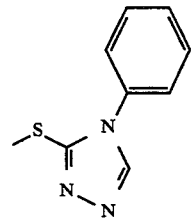

-continued

INH-7

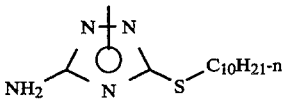

INH-8

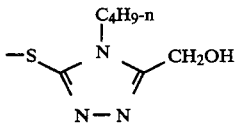

INH-9

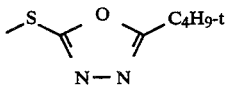

INH-9

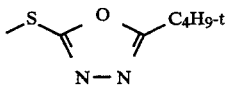

INH-10

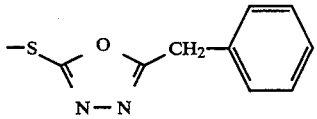

INH-11

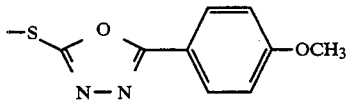

INH-12

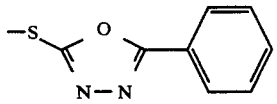

INH-13

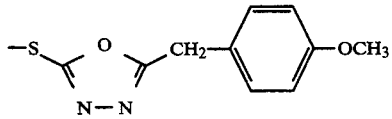

INH-14

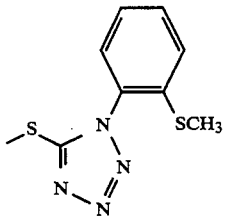

INH-15

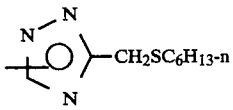

INH-16

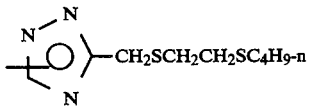

INH-17

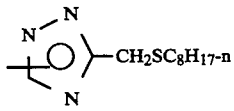

-continued

INH-18

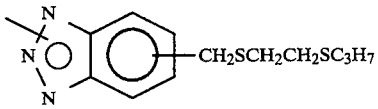

INH-19

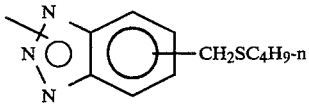

INH-20

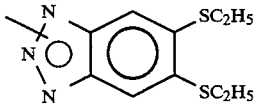

INH-21

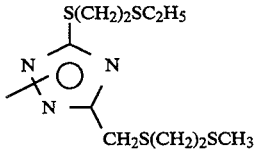

INH-22

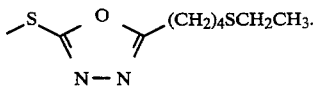

4. The method in accordance with claim 1 wherein CAR is a coupler moiety.

5. The method in accordance with claim 4 wherein the coupler moiety is ballasted.

6. The method in accordance with claim 5 wherein -(TIME)$_n$-INH is bonded to a coupling position of the coupler moiety.

7. The method in accordance with claim 4 wherein CAR is unballasted and the TIME moiety attached to CAR is ballasted.

8. The method in accordance with claim 1 wherein CAR is a moiety which can cross-oxidize with oxidized color developer, and is selected from the class consisting of hydrazides and hydroquinones.

9. A method according to claim 1 wherein each of the first and second layers of the color reversal element are color sensitized.

10. A method according to claim 1 wherein the silver halide of the first and second layers of the reversal element are sensitized to different colors.

11. A method according to claim 1 wherein the inhibitor releasing compound of the color reversal element is located in the first layer.

12. A method according to claim 1 wherein the surface fogged silver halide grains of the color reversal element have an average particle size of between 0.05 μm to 0.25 μm.

13. A method according to claim 1 wherein the second layer of the color reversal element contains the surface fogged grains at a concentration of 0.5% to 7.7% by weight of the imaging silver halide.

14. A method according to claim 1 wherein the silver halide of the first layer is sensitized to red light and the first layer contains a cyan dye forming coupler, and the silver halide of the second layer is sensitized to green light and the second layer contains a magenta dye forming coupler.

15. A method according to claim 11 wherein the second layer of the color reversal element comprises at least two sub-layers each with silver halide grains having the same spectral response but of differing sensitivities, the sub-layer of the lower sensitivity being closer to the first layer.

16. A method according to claim 11 wherein CAR is a coupler which reacts with oxidized color developer to form a dye while simultaneously releasing -TIME)$_n$-INH.

17. A method according to claim 14 wherein CAR is a coupler which reacts with oxidized color developer to form a dye while simultaneously releasing -(TIME)$_n$-INH.

* * * * *

IN THE UNITED STATES PATENT AND TRADEMARK OFFICE

CERTIFICATE OF CORRECTION

PATENT NO. : 5,399,466

DATED : March 21, 1995

INVENTOR(S) : John W. Hamer

It is certified that errors appear in the above-identified patent and that said Letters Patent is hereby corrected as shown below:

Title page, item[54], before METHOD delete " [ " and after PROCESSING delete " ] "

Column 60, line 37, delete " $IS = \frac{IN_{(test)}}{IN_{(control)}}$ "

Column 64, line 60, 7.7% should read " 7.5% "

Signed and Sealed this

Twenty-fifth Day of July, 1995

*Attest:*

*Attesting Officer*

BRUCE LEHMAN

*Commissioner of Patents and Trademarks*